US011344085B2

(12) United States Patent
Chambers et al.

(10) Patent No.: US 11,344,085 B2
(45) Date of Patent: May 31, 2022

(54) CORD LOCK APPARATUS AND BELT WITH SAME

(71) Applicant: LT Brands, Inc., Morgantown, WV (US)

(72) Inventors: Justin Ronald Chambers, Morgantown, WV (US); Ephraim Pittore-Candelario, Morgantown, WV (US)

(73) Assignee: LT BRANDS, INC., Morgantown, WV (US)

( * ) Notice: Subject to any disclaimer, the term of this patent is extended or adjusted under 35 U.S.C. 154(b) by 0 days.

(21) Appl. No.: 16/750,551

(22) Filed: Jan. 23, 2020

(65) Prior Publication Data

US 2020/0229548 A1 Jul. 23, 2020

Related U.S. Application Data

(60) Provisional application No. 62/795,856, filed on Jan. 23, 2019.

(51) Int. Cl.
*A44B 13/00* (2006.01)

(52) U.S. Cl.
CPC ..... *A44B 13/0058* (2013.01)

(58) Field of Classification Search
CPC ... A44B 13/0058; A44B 99/00; A41F 9/0025; A41F 9/002; F16G 11/146; F16G 11/00; F16G 11/06; Y10T 24/3916
See application file for complete search history.

(56) References Cited

U.S. PATENT DOCUMENTS 150,988 A * 5/1874 Edward ..... F16G 11/00 24/129 R
179,168 A * 6/1876 Dunn ..... F16G 11/00 403/210
189,274 A * 4/1877 Smith ..... F16G 11/06 24/135 R
366,971 A * 7/1887 Michaelis ..... F16G 11/00 24/129 R (Continued)

FOREIGN PATENT DOCUMENTS

GB 754786 8/1956

OTHER PUBLICATIONS

Anonymous, "APIA Mens Womens Thimble Charm Bracelets Paracord Rope Wristbands Blac—Fathom Bracelets", Fathom, https://fathombracelets.com/products/apia-mens-womens-thimble-charm-bracelets-paracord-rope-wristbands-black-grey, accessed Jan. 17, 2020, 4 pages.

(Continued)

*Primary Examiner* — Robert Sandy
*Assistant Examiner* — Rowland Do
(74) *Attorney, Agent, or Firm* — Andrew D. Wright; Roberts Calderon Safran & Cole, P.C.

(57) ABSTRACT

An article of clothing in the form of a belt includes: a cord having a proximal end and a distal end; and an eyelet having an opening and a locking feature; wherein the proximal end of the cord is looped around the eyelet; the distal end of the cord is configured to pass through the opening, wherein the cord and the eyelet combine to form a continuous closed loop when the distal end of the cord is passed through the opening; and the locking feature is structured and arranged to selectively lock and unlock movement of the cord through the opening.

20 Claims, 26 Drawing Sheets

(56) References Cited

U.S. PATENT DOCUMENTS

| | | | | |
|---|---|---|---|---|
| 1,069,135 | A * | 8/1913 | Heberling | F16G 11/10 24/132 R |
| 1,075,179 | A * | 10/1913 | Westberg | A01K 15/003 119/805 |
| D111,615 | S | 10/1938 | Richtmyer et al. | |
| 2,322,869 | A | 6/1943 | Mohr | |
| 3,068,316 | A | 6/1959 | Witt | |
| 3,161,890 | A | 12/1962 | Betz | |
| 3,163,902 | A | 1/1965 | Bernburg et al. | |
| 3,358,338 | A | 12/1967 | Clasen | |
| 5,568,952 | A | 10/1996 | Ruegg | |
| 5,950,284 | A | 9/1999 | Persson | |
| 6,345,418 | B1 | 2/2002 | Bertrand et al. | |
| D767,250 | S | 9/2016 | Poggi | |
| 10,051,925 | B2 | 8/2018 | Fennell | |
| 10,309,443 | B1 * | 6/2019 | Driver | F16G 11/04 |
| 2005/0155194 | A1 * | 7/2005 | Christiansson | B63C 9/22 24/326 |
| 2011/0052314 | A1 | 3/2011 | Lindsey | |
| 2012/0042494 | A1 | 2/2012 | Fay | |
| 2018/0242668 | A1 | 8/2018 | Earnshaw | |
| 2019/0223531 | A1 | 7/2019 | Alekseev | |

OTHER PUBLICATIONS

Anonymous, "Quick Grip and Release Rope Belt", Etsy, https://www.etsy.com/sg-en/listing/579172324/quick-grip-and-release-rope-belt?ga_order=most_relevant&ga_search_type=all&ga_view_type=gallery&%E2%80%A6, accessed Jan. 17, 2020, 2 pages.

Robson, "Lash Thimbles—What are they, and how do I use them?", https://www.sail-worldcruising.com/news/215523/Lash-Thimbles, Mar. 25, 2019, 4 pages.

Anonymous, "Climbing Rope Belt—Festive", https://www.changingtides.global/products/climbing-rope-belt-festive, accessed Jan. 17, 2020, 4 pages.

Anonymous, "Belt size M (approx. 115 cm) with ring closure, upcycling from a disused climbing rope", Etsy, https://www.etsy.com/sg-en/listing/722359247/belt-size-m-approx-115-cm-with-ring, accessed Jan. 17, 2020, 4 pages.

Anonymous, "30mm—Millennium™ Black Buckle", https://bisondesigns.com/products/30mm-millennium™-black-buckle, Bison Designs, accessed Jan. 20, 2020, 2 pages.

Anonymous, "Sports Belt 3/4" w/ Plastic Cam Buckle & Lightweight Polypropylene", https://www.strapworks.com/ProductDetails.aspProductCode=SBPC34L&gclid=EAIaIQobChMlkvTWusWS5wIVh5WzCh089AksEAQYCSABEgIXT_D_BwE, accessed Jan. 20, 2020, 4 pages.

Anonymous, "Trackside Wheel Tie-Down Strap", https://www.revzilla.com/motorcycle-tires, Revzilla, accessed Jan. 20, 2020, 1 page.

Anonymous, "PRO-ROD—Thimbles DIN 3091", https://www.prolift-lifting.com/products/thimbles-pro-rod, PROlift, accessed Jan. 20, 2020, 2 pages.

Anonymous, "Netform™ Steel Reinforced Rope", https://incord.com/, Incord, accessed Jan. 20, 2020, 15 pages.

Anonymous, "Patagonia Friction Belt", https://www.graffitishop.net/Patagonia-Friction-Belt-Black-59178-blk-Belts-Accessories-id130887, Graffitishop, accessed Jan. 20, 2020, 1 page.

International Search Report and Written Opinion dated Apr. 16, 2020 for corresponding PCT Application PCT/US20/14735, 11 pages.

Office Action dated Oct. 29, 2021 for US Application 17/025,612,16 pages.

* cited by examiner

CORD LOCK APPARATUS AND BELT WITH SAME

FIELD OF THE INVENTION

Aspects of the invention generally relate to cord locking devices and articles of clothing including a cord and a cord locking device.

BACKGROUND

Traditional belts that are worn around the waist of a user are often ill-fitting, which can cause physical discomfort in the user. For example, a conventional belt with a buckle that engages one of plural holes in the belt strap is limited to a fixed number of discrete sizes that are defined by the different holes in the belt strap. This type of belt often results in a too tight or too loose fit on many users and does not allow easy adjustment on the go. Additionally, traditional belts can have straps and buckles that are bulky, have sharp edges, produce uncomfortable fits and further aspects that can be undesirable to the user.

SUMMARY

According to aspects of the invention, a cord lock apparatus includes an eyelet that a cord can pass through. In one embodiment, the eyelet includes concentric teeth such that when the entry cord axis and eyelet axis approach a perpendicular orientation to each other, the teeth engage the cord. The engaging of the teeth locks the cord from moving through the eyelet. In another embodiment, the eyelet is devoid of teeth and instead has at least one edge that is used to selectively engage the cord to prevent movement of the cord through the eyelet. In a preferred embodiment, a combination of the eyelet and a cord attached to the eyelet are configured as an article of clothing, in particular a belt that is worn around the waist of a user, e.g., for holding garments such as pants, shorts, etc.

In a first aspect of the invention, there is an apparatus comprising: an eyelet consisting of teeth positioned at the eyelet opening configured to allow cord to pass through parallel to the central axis of the eyelet. In embodiments, the eyelet teeth are arranged in a concentric pattern at both eyelet openings. In embodiments, the eyelet teeth engage a passing cord when the cord axis is positioned between a 15 degree and a 45 degree angle relative to the central axis of the eyelet. In embodiments, the eyelet is configured to be secured within a cord loop.

In another aspect of the invention, there is an apparatus comprising: a cord with a fixed length having a proximal and distal end, wherein an eyelet is attached to the proximal end comprising teeth positioned at the opening configured to allow the distal end of the cord to pass through parallel to the central axis of the eyelet. In embodiments, the cord is worn around the waist as a belt. In embodiments, the cord locks when the cord is perpendicular to the central axis of the eyelet. In embodiments, there is a range of angles at which the cord will start to lock relative the eyelet. In this regard, as a user starts to move the cord from the parallel position to the perpendicular position, the cord will start to engage the teeth at as little as a 15 degree angle. As the angle increases, the lock will become stronger and carry more tension before slipping. In embodiments, the cord can be cut to fit a specific waist size. In embodiments, the cord can be adjusted by the user by changing the angle for which the distal end of the cord is relative to the central axis of the eyelet.

In another aspect of the invention, there is an apparatus including: a cord comprising a proximal end and a distal end; and an eyelet comprising an opening and a locking feature; wherein the proximal end of the cord is looped around the eyelet; the distal end of the cord is configured to pass through the opening, wherein the cord and the eyelet combine to form a continuous closed loop when the distal end of the cord is passed through the opening; and the locking feature is structured and arranged to selectively lock and unlock movement of the cord through the opening.

In another aspect of the invention, there is an apparatus including: an eyelet comprising a stem, an opening, and a locking feature, wherein the locking feature is structured and arranged to selectively lock and unlock movement of a cord through the opening; the eyelet is a unitary structure and has no moving parts; and the opening is the only opening through the eyelet.

In another aspect of the invention, there is an apparatus including: a cord comprising a proximal end and a distal end; and an eyelet comprising an opening and a locking feature, wherein the proximal end of the cord is looped around the eyelet; the distal end of the cord is configured to pass through the opening, wherein the cord and the eyelet combine to form a continuous closed loop when the distal end of the cord is passed through the opening; and the locking feature engages the cord and locks the cord relative to the eyelet when the cord is positioned within the opening with its long axis non-parallel to an axis of the opening.

BRIEF DESCRIPTION OF THE SEVERAL VIEWS OF THE DRAWINGS

Aspects of the present invention are described in the detailed description which follows, in reference to the noted plurality of drawings by way of non-limiting examples of exemplary embodiments of the present invention.

DETAILED DESCRIPTION

Figure 1:
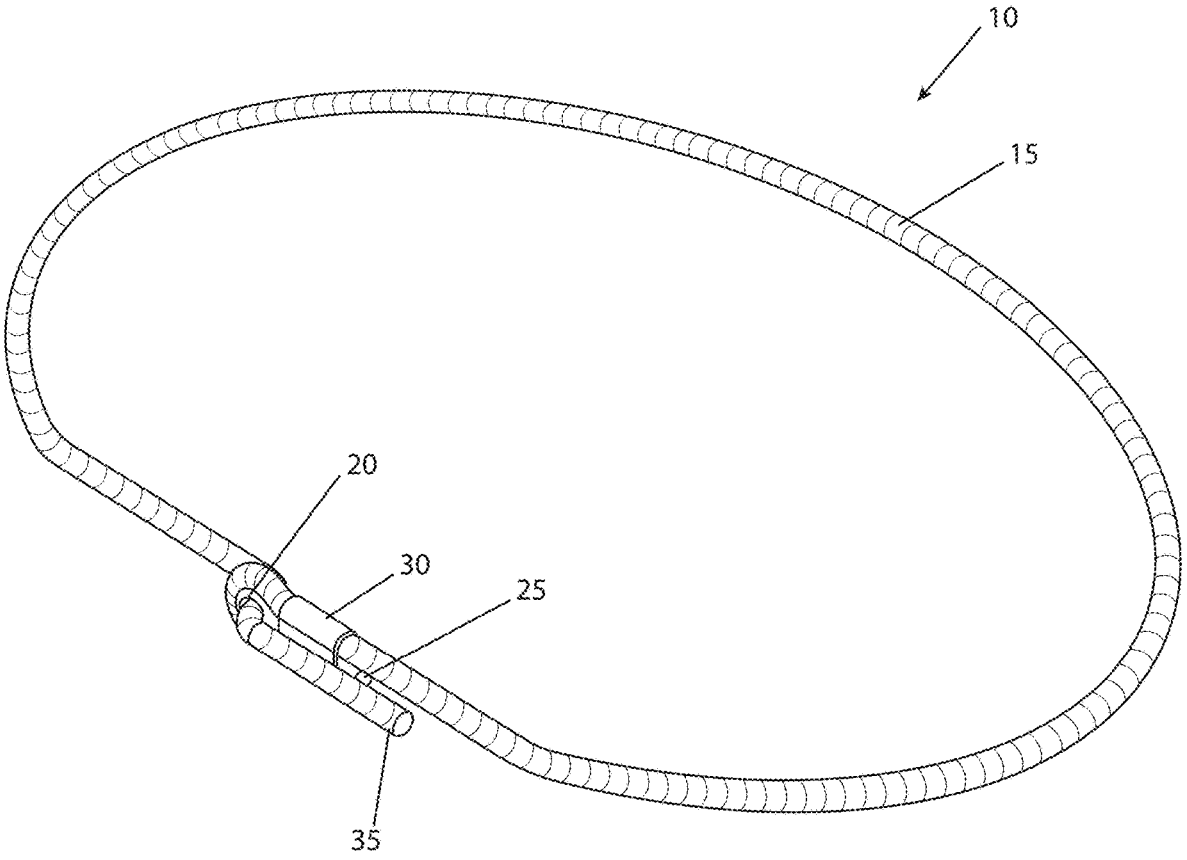
FIG. 1 shows a belt comprising a lock apparatus in accordance with aspects of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of aspects of the present invention in more detail than is necessary for the fundamental understanding of the aspects of the present invention, the description taken with the drawings making apparent to those skilled in the art how the several forms of aspects of the present invention may be embodied in practice.

Aspects of the invention generally relate to cord locking devices and articles of clothing including a cord and a cord locking device. Embodiments of the invention include an apparatus to lock and unlock a cord and restrict the cord from moving. A first embodiment utilizes an eyelet that includes plural concentric teeth at each of the inlet and outlet of the eyelet. A second embodiment utilizes edges (e.g., ridges) at the inlet and outlet of the eyelet. In both embodiments, the eyelet is secured inside of a loop made in the cord which allows the cord to pass through the eyelet. The eyelet provides a releasable lock to the cord. As the cord passes through the eyelet parallel to the central axis of the eyelet, the eyelet allows the cord to pass freely. When the cord is turned to approach a perpendicular orientation to the eyelet axis the eyelet, the teeth or edges are engaged and this secures the cord from moving. The teeth or edges can engage the cord at a very low angle and as the angle increases so does the teeth/edge engagement resulting in higher tension capacities. The eyelet can be maneuvered or positioned in various angles to adjust teeth/edge engagement and various cord slippage forces. Additionally, the eyelet can be designed or modified to meet a desired engagement angle or tension capacity. The eyelet can be released by moving it towards the parallel position. The eyelet can be reengaged by moving back to the perpendicular position. The tension applied to the eyelet by the distal end of the cord can also provide for self-locking or self-arresting eyelet to the locking position. An embodiment of the eyelet design requires no moving parts and allows for easy adjustment from the unlocked and locking position and anywhere in between.

A preferred embodiment uses the described eyelet and cord as a belt to be worn around the waist of a user. In this embodiment, the eyelet is secured to the proximal end of the cord within a loop of the cord, leaving the distal end of the cord available to go through the eyelet. This embodiment comprising a belt arrangement has the following features: it allows to the cord to slide easily under compression but engage and lock under tension; it allows for multiple adjustable positions; it is releasably locking; and it can be designed to slip at a specific tension.

FIG. 1 shows a belt 10 comprising a lock apparatus in accordance with aspects of the invention. In embodiments, the belt 10 comprises a cord 15 attached to an eyelet 20, with the eyelet 20 functioning as the lock apparatus. As shown in FIG. 1 and subsequent figures, a proximal end 25 of the cord 15 is looped around the eyelet 20 and connected to an intermediate portion of the cord 15 by a sleeve 30, and a distal end 35 of the cord 15 is selectively passed through and locked in the eyelet 20. As illustrated in FIG. 1, the cord 15 and the eyelet 20 combine to form a continuous closed loop when the distal end 35 of the cord 15 is passed through an opening in the eyelet 20. In this manner, the belt 10 can be worn around the waist of a user.

In embodiments, the cord 15 comprises an elongate flexible member such as a rope. In a particular embodiment, the cord 15 comprises a rope comprising a core and a sheath around the core. The cord 15 may be composed of any suitable materials, including without limitation: organic material (e.g., cotton, hemp, etc.), polymer material (e.g., nylon, dacron, etc.), and a mixture of organic and polymer materials. In an example embodiment, the cord 15 has a diameter of about 8 mm and a length of between 24 and 56 inches, although other diameters and lengths may be used in implementations of the invention. In a particular preferred embodiment, the cord 15 comprises an 8 mm climbing rope comprising a core and a braided nylon sheath around the core, and has a length of between 24 and 56 inches.

According to aspects of the invention, the eyelet 20 defines a circular opening the cord 15 passes through, a concave seat the cord 15 sits in, and a locking feature that selectively locks and unlocks movement of the cord 15 through the circular opening. In one embodiment, the locking feature consists of teeth around the opening of the eyelet 20. In another embodiment, the locking feature consists of one (or two) sharp edges formed at the edges of the opening of the eyelet. In both embodiments, the eyelet 20 has only a single opening through which the cord 15 passes through only a single time. In both embodiments, the eyelet 20 is devoid of (i.e., does not include) moving parts.

In embodiments, the eyelet 20 comprises a unitary element composed of a single material. In one example, the eyelet 20 is a unitary element composed of sturdy polymer, and is formed using molding, milling, or 3D printing techniques. In another example, the eyelet 20 is a unitary element composed of metal or metal alloy, and is formed using forging, stamping, or milling techniques.

In embodiments, the distal end 35 is provided with an end termination that prevents fraying of the cord 15. In embodiments, the end termination is the same size or smaller than the outer diameter of the cord 15, so that the end termination fits through the opening in the eyelet 20. In one example, the end termination comprises a sleeve that compresses the tip of the distal end 35 of the cord 15 (the sleeve may be shrink fit, sewn, and/or adhered to the cord 15). In another example, the end termination comprises a melted portion of the sheath of the cord 15. In embodiments, in addition to having an end termination, the distal end 35 of the cord 15 is devoid of (i.e., does not have) any loops, knots, and rigging and/or connecting hardware. Such additional elements would prevent the distal end 35 from passing through the opening in the eyelet 20 in the manner described herein.

FIGS. 2-11B show an embodiment of the belt 10 in accordance with aspects of the invention. As shown in FIGS. 2-11B, the belt 10 comprises the cord 15, sleeve 30, and eyelet 20' (which corresponds to the eyelet 20 shown in FIG. 1).

Figure 2:
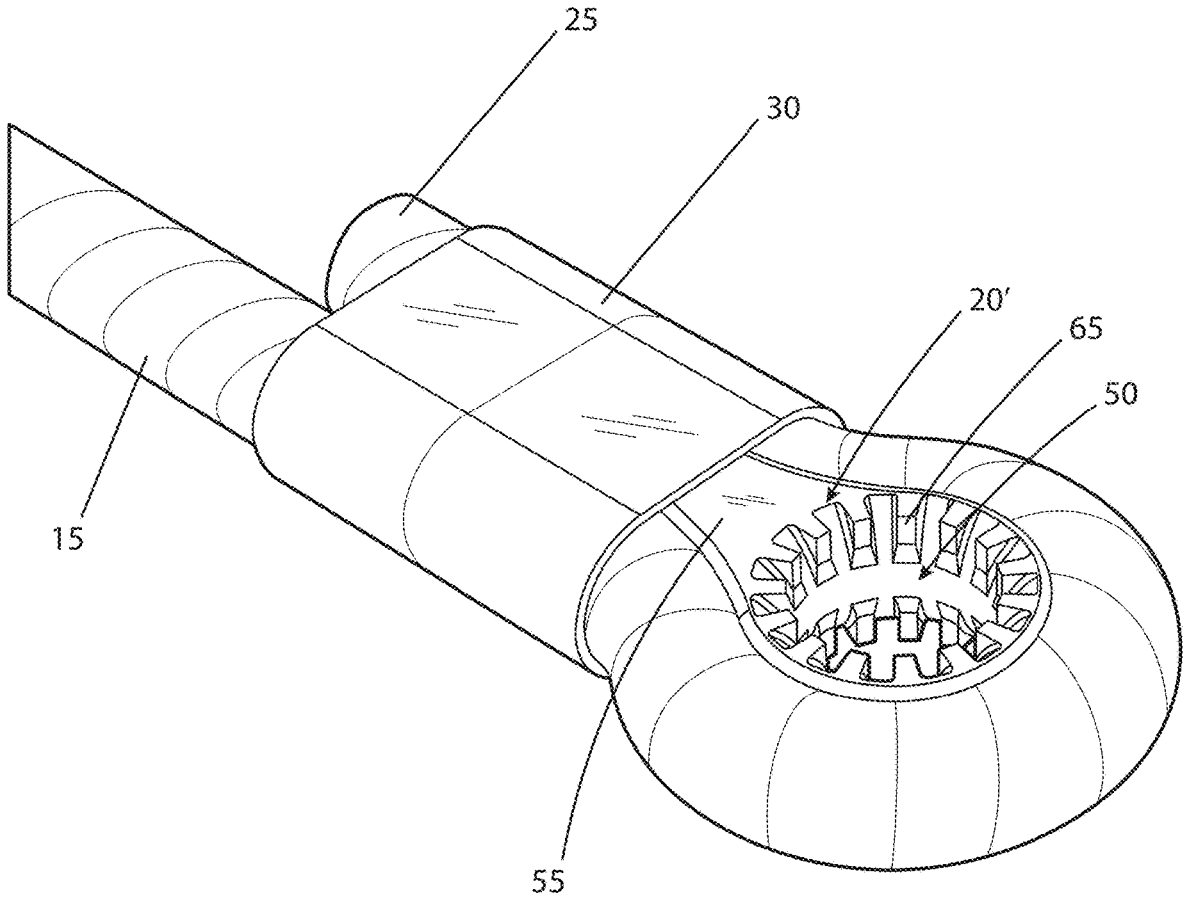
FIGS. 2-11B show an embodiment of the belt in accordance with aspects of the invention.
Figure 3:
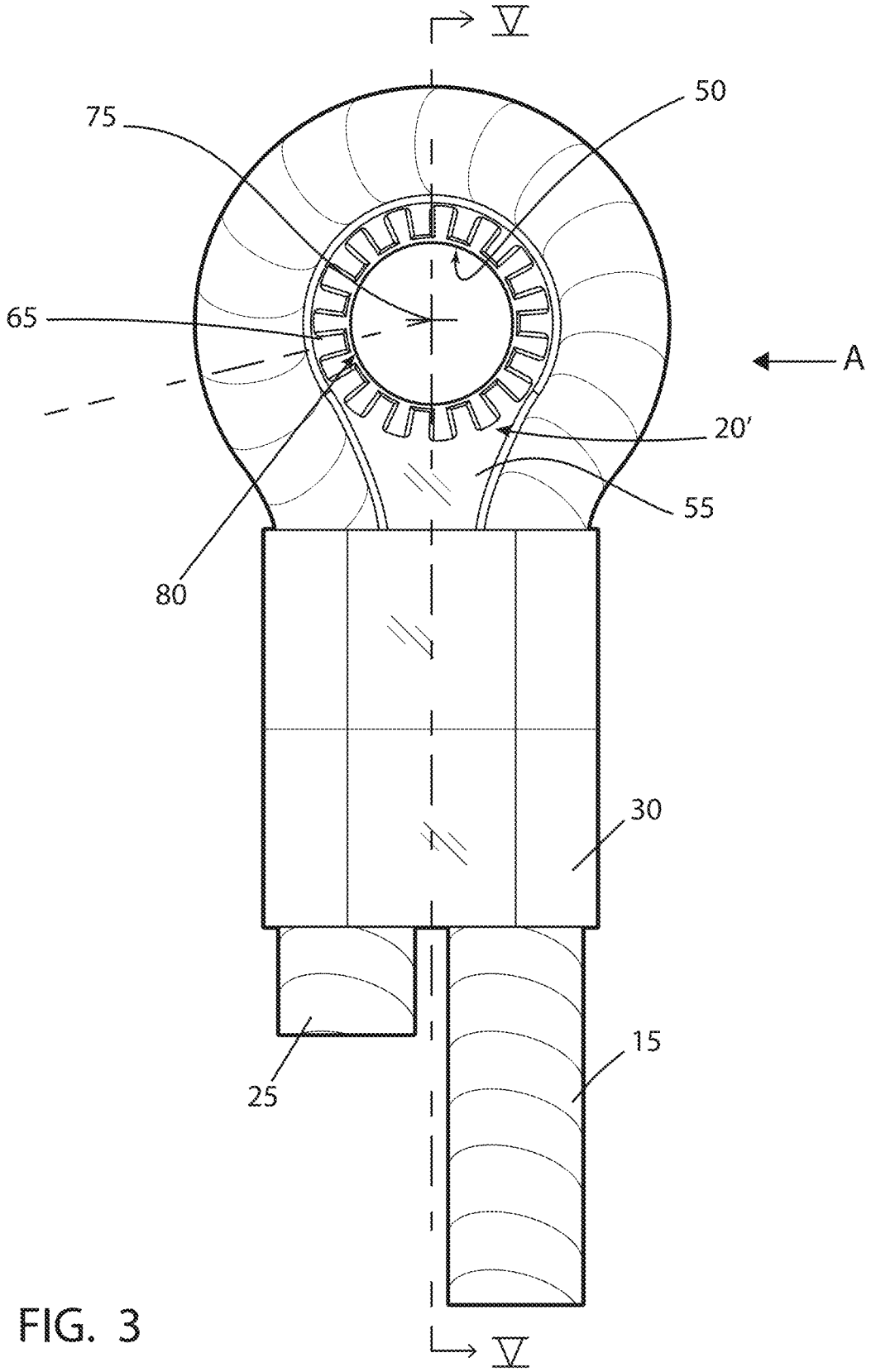

FIG. 2 shows a perspective view of a portion of the belt 10 including the proximal end 25 of the cord 15 wrapped around the eyelet 20'. FIG. 3 shows a front view of the portion of the belt.

Figure 4:
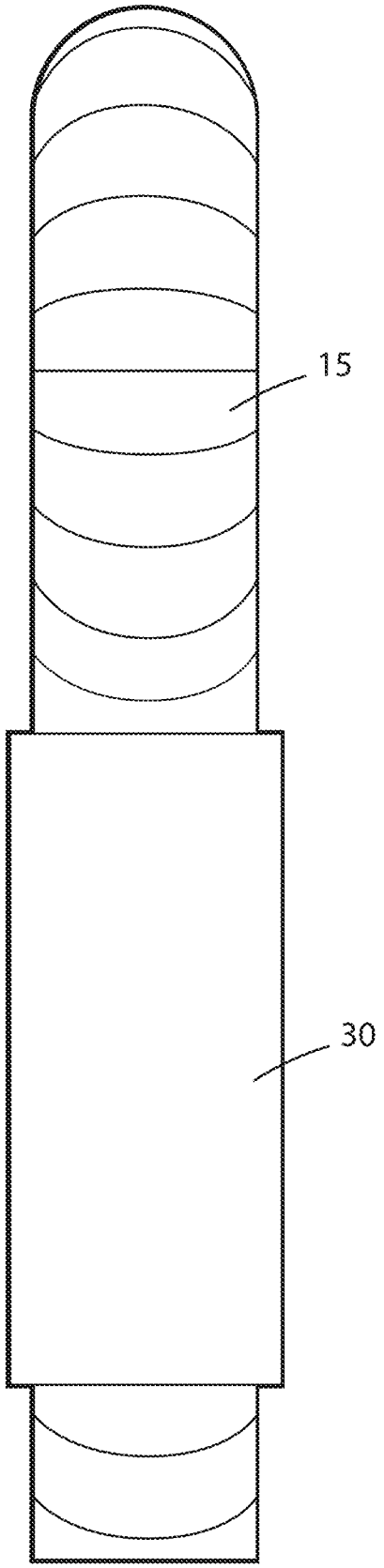
Figure 5:
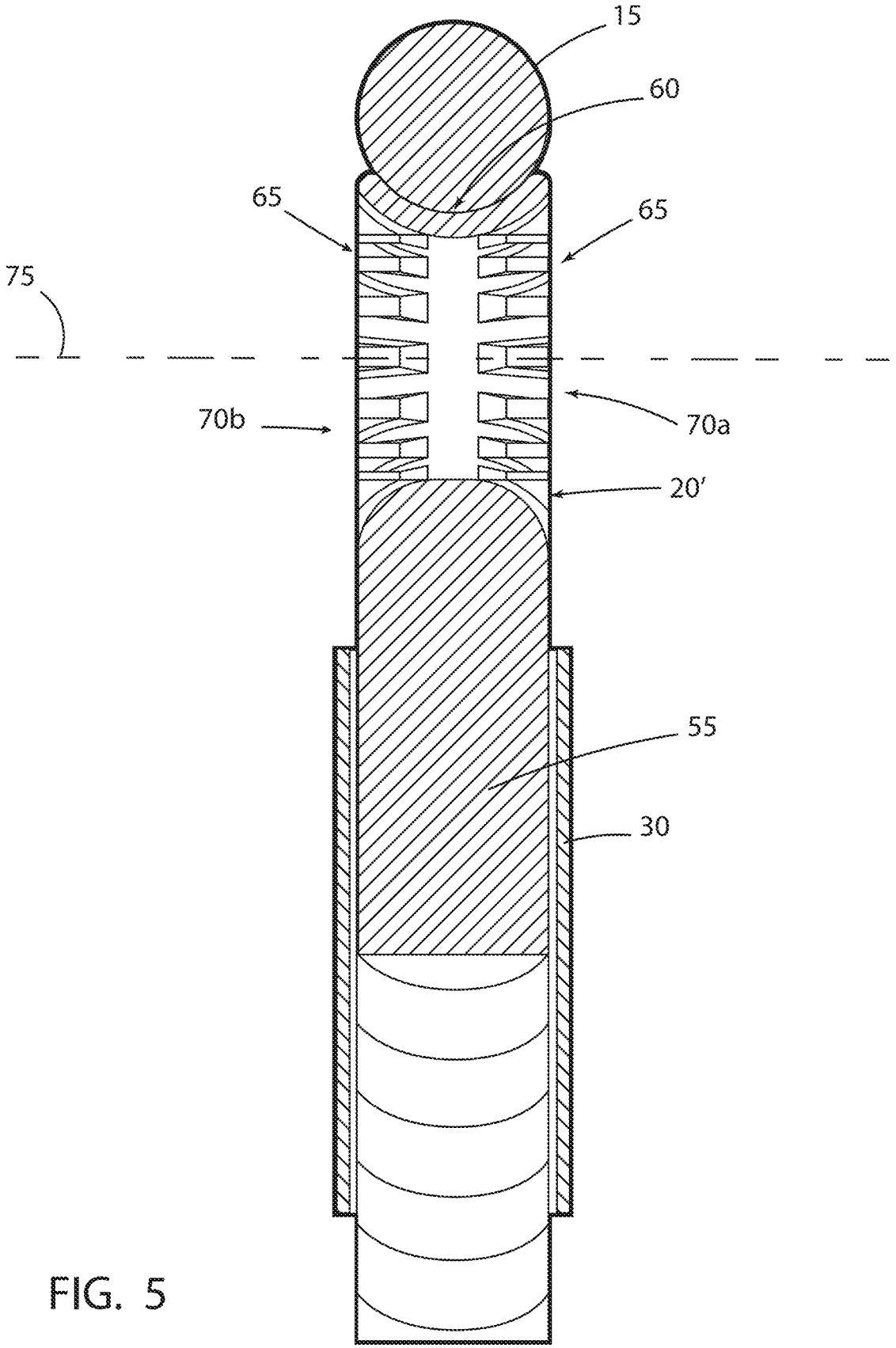

FIG. 4 shows a side view of the portion of the belt looking the direction of arrow A shown in FIG. 3, without the distal 35 end of the cord 15 passing though the eyelet 20'. FIG. 5 shows a side cutaway view of the portion of the belt along line V-V of FIG. 3.

Figure 6:
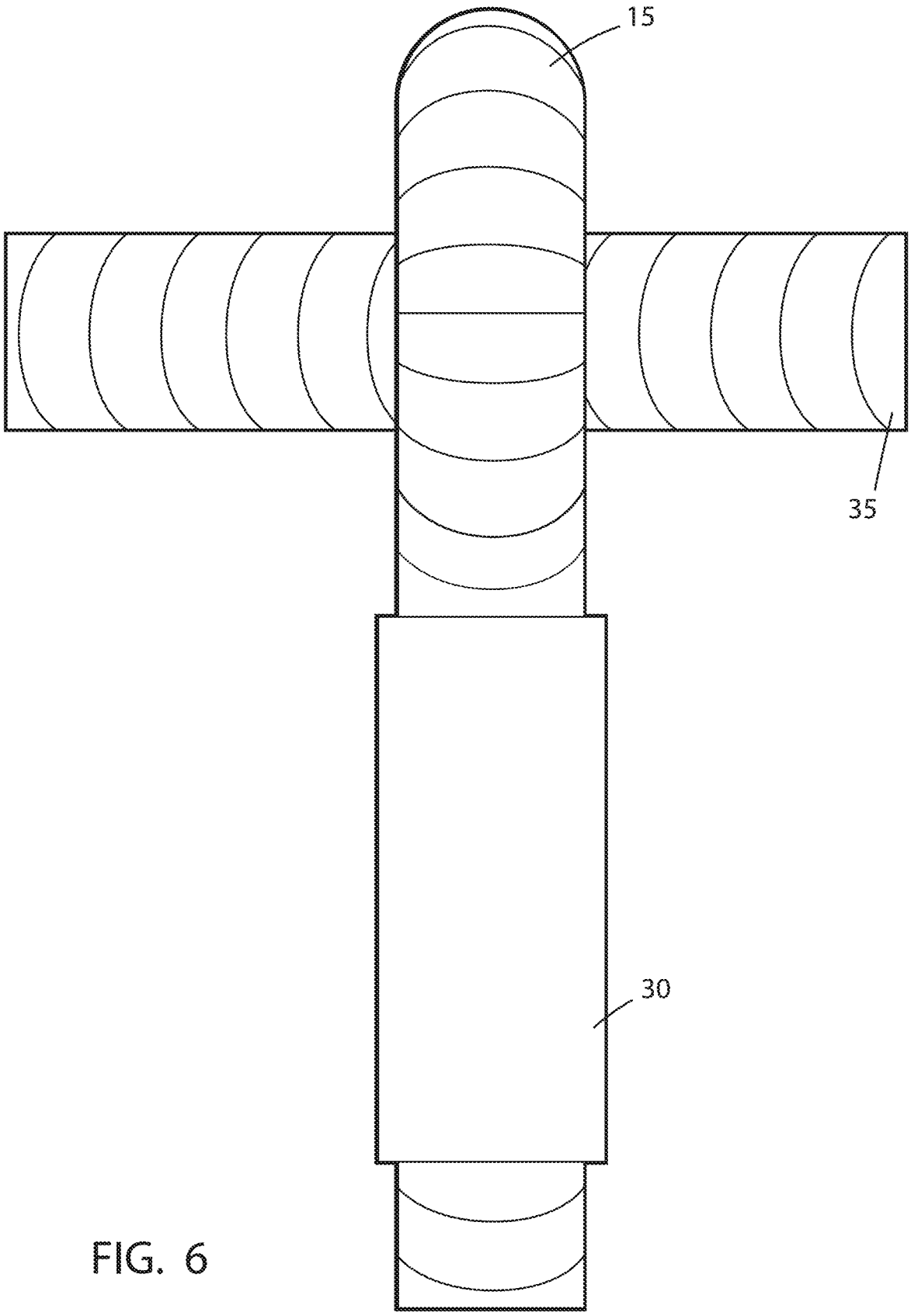

FIG. 6 shows a side view of the portion of the belt of FIG. 3, with the distal end 35 of the cord 15 passing though the eyelet 20' in an unlocked position. The view shown in FIG. 6 is along the same direction as the view of FIG. 4.

Figure 7:
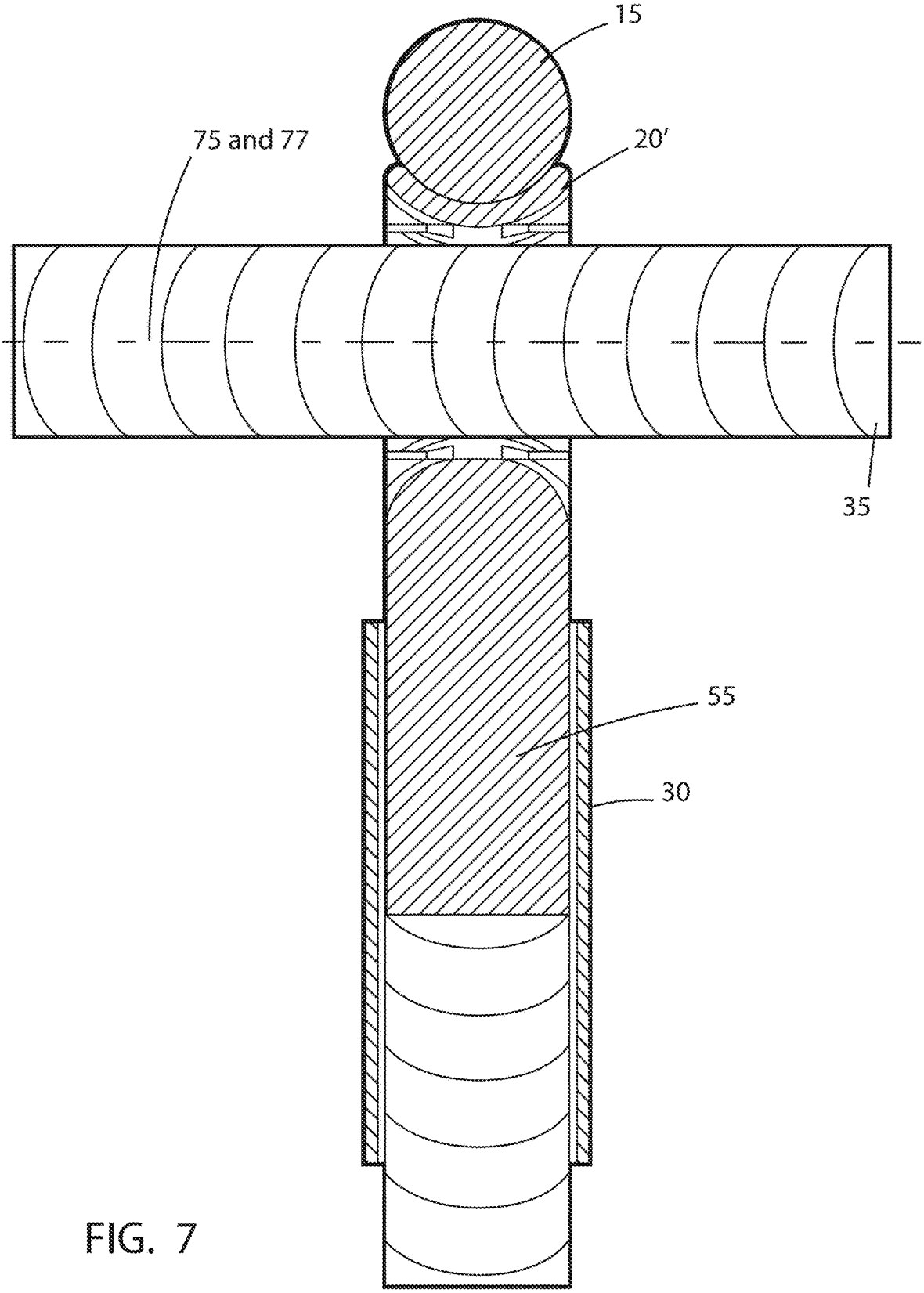

FIG. 7 shows a side cutaway view of the portion of the belt of FIG. 6 with the distal end 35 of the cord 15 passing though the eyelet 20' in the unlocked position. The view shown in FIG. 7 is along the same direction and cutaway plane as the view of FIG. 5.

Figure 8:
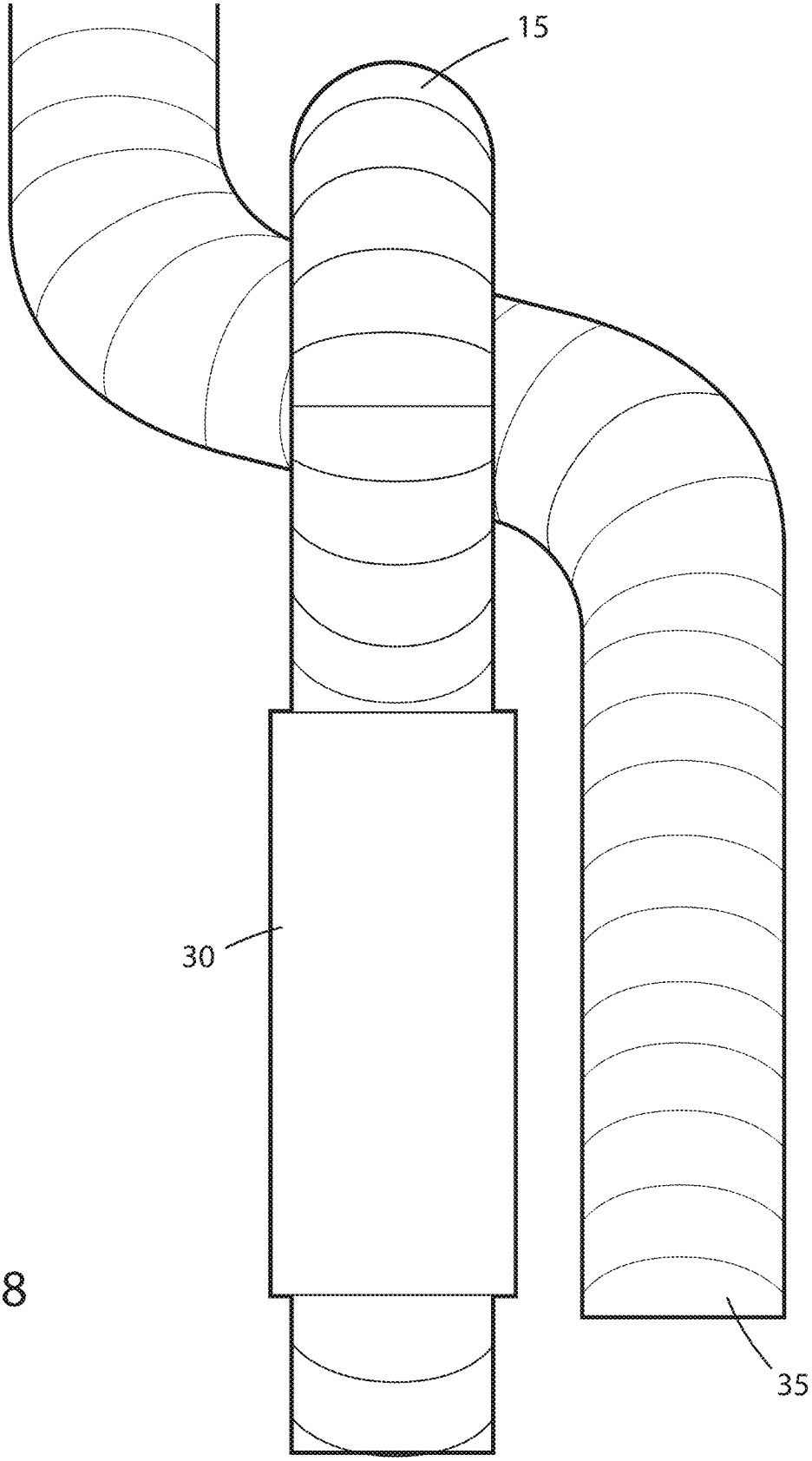

FIG. 8 shows a side view of the portion of the belt of FIG. 3, with the distal end 35 of the cord 15 passing though the eyelet 20' and bent in a locked position. The view shown in FIG. 8 is along the same direction as the view of FIG. 4.

Figure 9:
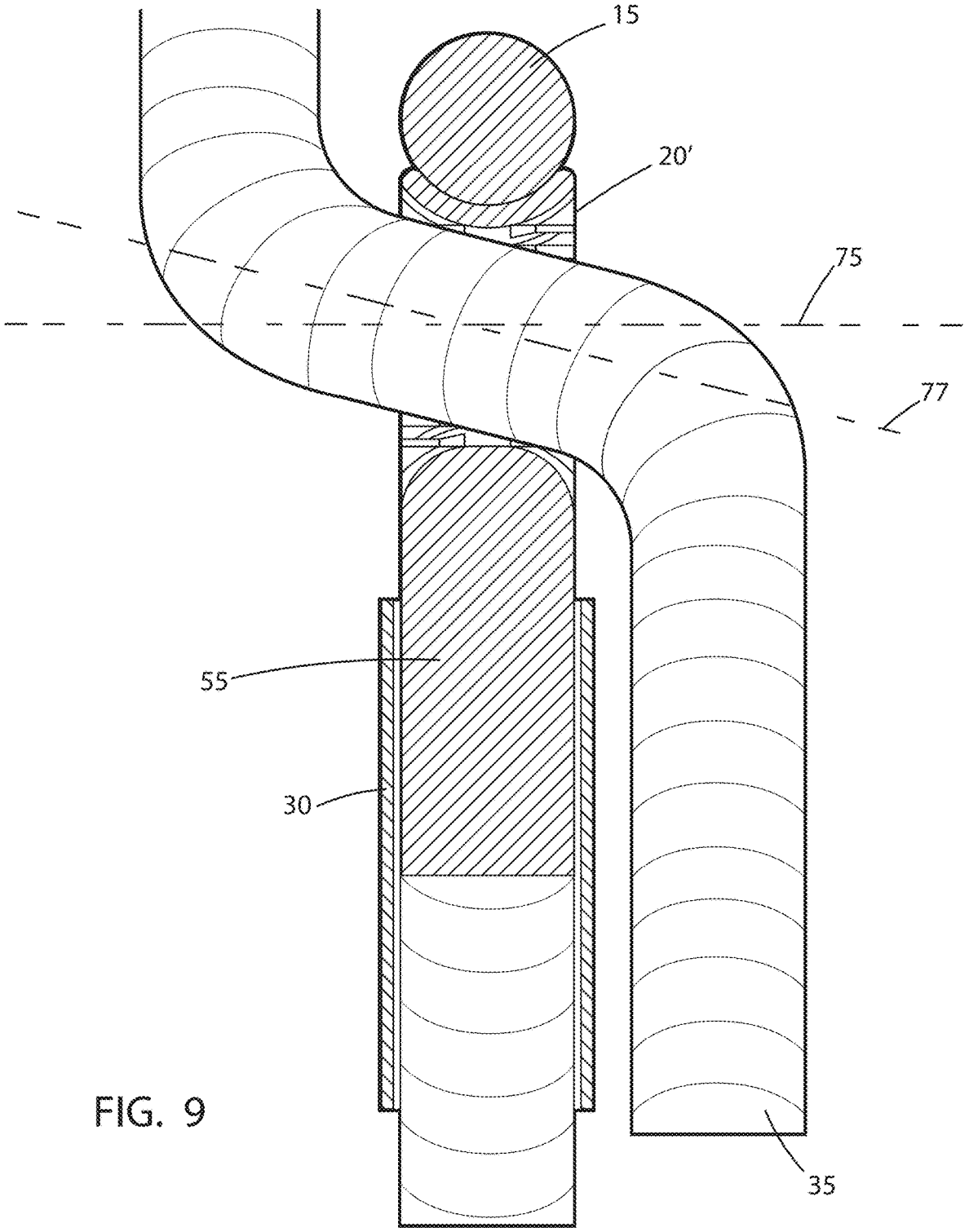

FIG. 9 shows a side cutaway view of the portion of the belt of FIG. 8 with the distal end 35 of the cord 15 passing though the eyelet 20' and bent in the locked position. The view shown in FIG. 9 is along the same direction and cutaway plane as the view of FIG. 5.

Figure 10A:
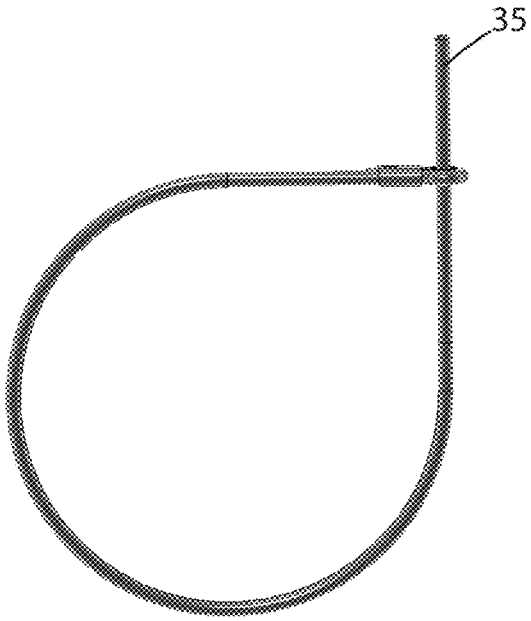
Figure 10B:
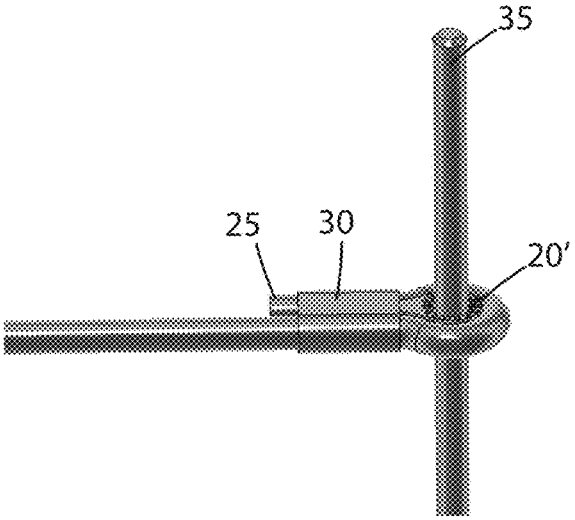
Figure 11B:
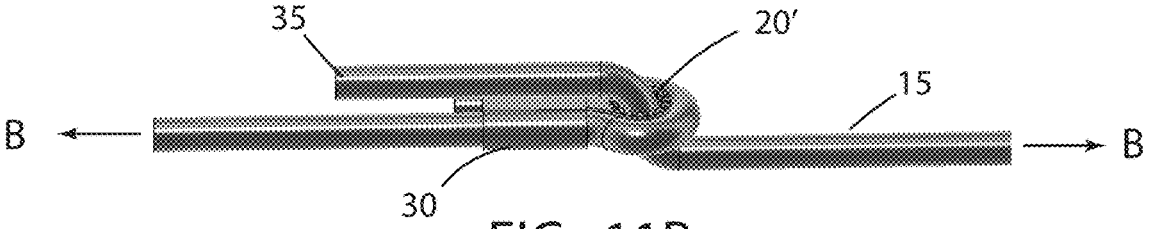
Figure 11A:
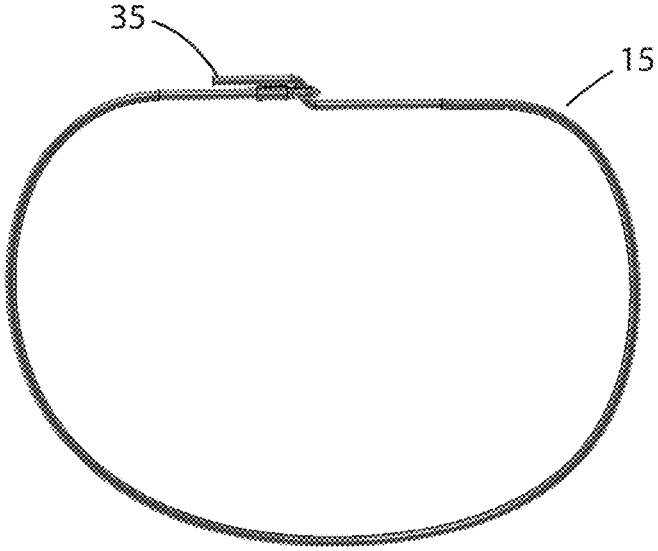

FIGS. 10A, 10B, 11A and 11B show an exemplary use case of the belt 10 of FIGS. 2-9. In particular, FIGS. 10A and 10B show the belt 10 in the unlocked position (i.e., the position shown in FIGS. 6 and 7), and FIGS. 11A and 11B show the belt 10 in the locked position (i.e., the position shown in FIGS. 8 and 9).

As shown in FIGS. 2 and 3, the eyelet 20' comprises a body that defines an opening 50 and a stem 55. As shown in FIG. 5, the body of the eyelet 20' also defines a concave seat 60 that is sized and shaped to receive the cord 15. In embodiments, the proximal end 25 of the cord 15 is looped around the eyelet 20' such that a portion of the cord 15 is positioned in and against the seat 60 around the exterior of the eyelet 20'. In embodiments, a radius of curvature of the concave seat 60 is substantially equal to a radius of curvature of the outer diameter of the cord 15 (e.g., plus or minus 0% to 2% difference) so that the cord 15 fits securely in the seat 60. The sleeve 30 fixes the loop by securely fastening the proximal end 25 of the cord 15 to an intermediate portion of the cord 15, with the stem 55 positioned there between. In this manner, the eyelet 20' is fixedly connected to the cord 15. The sleeve 30 may comprise different types of means for securing an end of a cord to an intermediate portion of the cord, including without limitation: shrink tubing, a polymer and/or organic material sleeve adhered to and/or sewn to the cord 15, whipping (e.g., with thread of string having a smaller outside diameter than the cord 15), etc.

Figure 21:
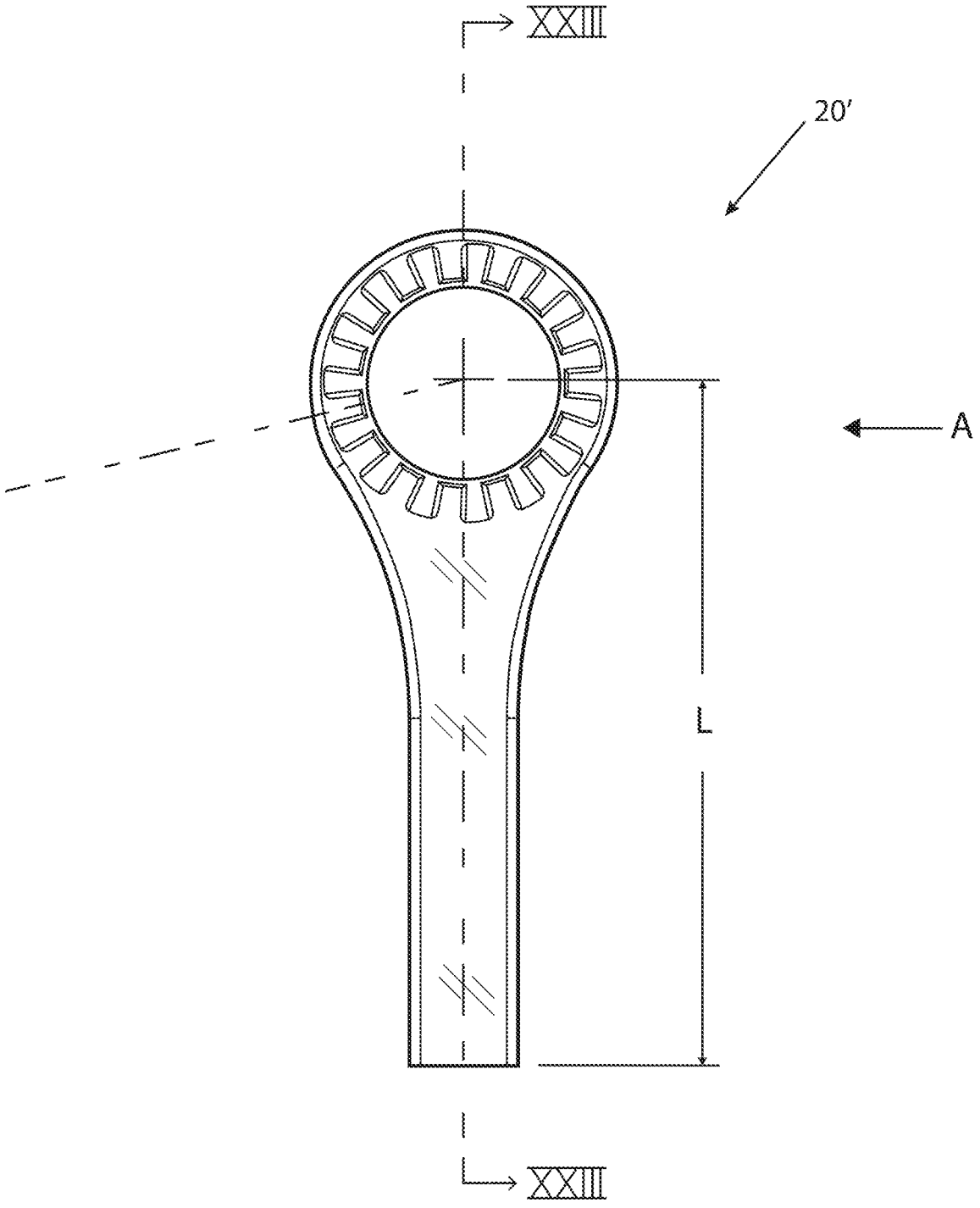
Figure 25:
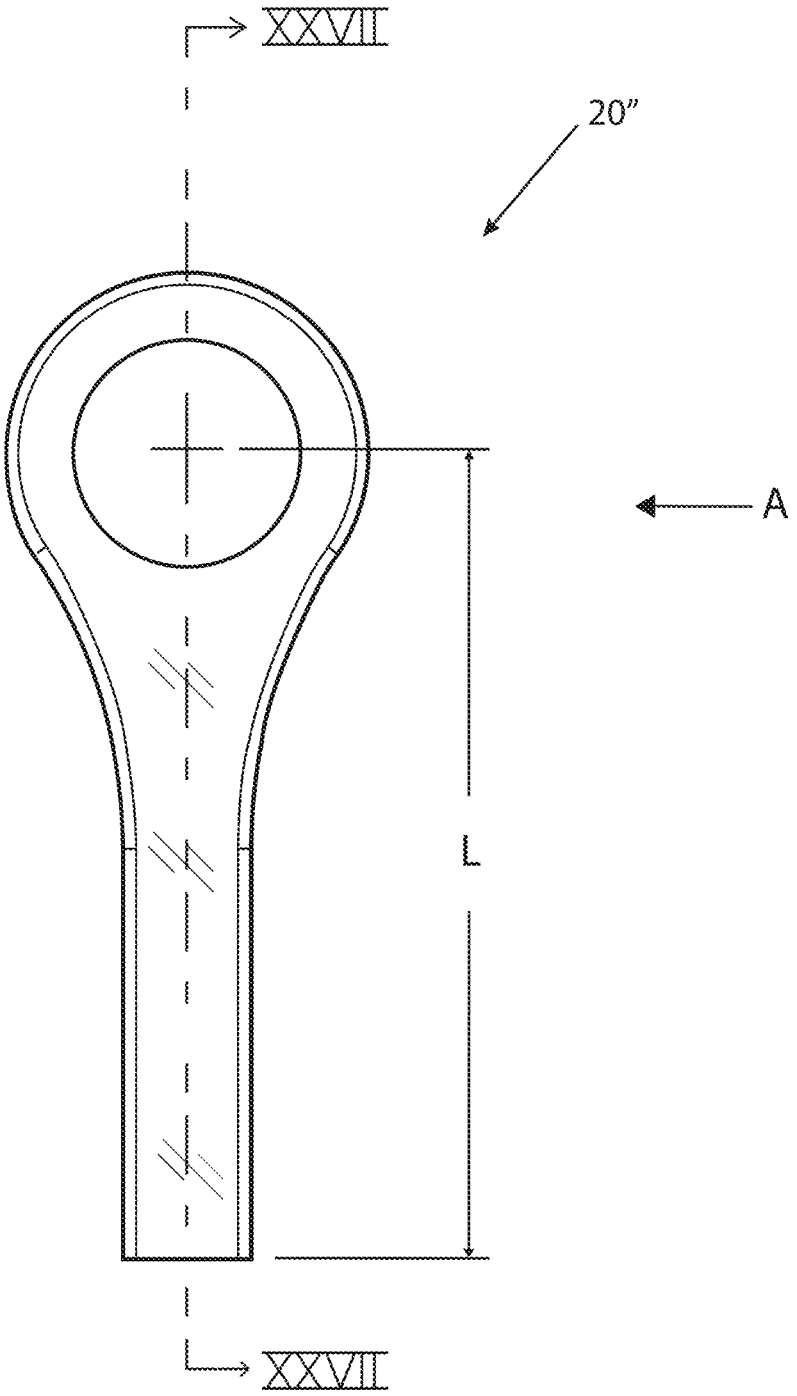

In embodiments, a length of the stem 55 as measured from an axis 75 of the eyelet to the distal end of the stem is 0.5 inches to 2.0 inches (as shown by "L" in FIGS. 21 and 25). In accordance with aspects of the invention, the stem 55 provides rigidity to a portion of the cord 15 that contacts the stem 55, and this rigidity prevents the cord 15 from bending too close to the eyelet 20' which bending could cause the eyelet 20' to inadvertently release the distal end of the cord 15. Additionally, this rigidity advantageously urges the eyelet 20' into the locked position when a user applies a tension force to portions of the cord 15 on opposite sides of the eyelet 20' with the distal end of the cord 15 positioned through the opening. This rigidity and urging of the eyelet 20' and cord into the locked position (in response to the user pull force) contributes to a self-locking feature of the belt 10.

In accordance with aspects of the invention, the opening 50 is an opening through the eyelet 20' that the distal end 35 of the cord 15 is designed to pass through and be selectively locked, by the locking feature, relative to the eyelet 20'. The opening 50 is shown in the figures as a circular opening. However, the opening 50 may have other shapes provided that the shape achieves the selective locking and unlocking as described herein. In some embodiments, the opening 50 is a circular opening and the diameter of the opening 50 is substantially equal to the outer diameter of the cord 15 (e.g., plus or minus 0% to 2% difference in the diameters). In this manner, the cord 15 fills essentially the entire opening 50 when the cord 15 is positioned in the opening 50 in the unlocked position. In this exemplary embodiment, these matching dimensions provide the advantage of producing a static friction force between the cord 15 and the eyelet 20' when the distal end 35 of the cord 15 is positioned in the opening 50 of the eyelet 20' in the unlocked position. This static friction force (in the unlocked position) is of sufficient magnitude to prevent the distal end 35 of the cord 15 from slipping or moving in the opening 50 under its own weight, but is also sufficiently small that it is easily overcome by a user applying a pushing or pulling force to move the cord 15 within the eyelet 20'. This differentiates embodiments of the invention from traditional belts in which a diameter of an opening of an eyelet is much larger than an outside diameter of a material passing through the eyelet, since such traditional belts do not have the degree of static friction described herein.

According to aspects of the invention, the eyelet 20' comprises teeth 65 on opposite sides 70*a* and 70*b* of the opening 50. In embodiments, the teeth 65 on each side are arranged concentrically around an axis 75 that defines the center the opening 50. In embodiments, the teeth 65 on each side have equal size with one another and equal spacing between one another. In the example shown, each side has fifteen teeth 65, although other numbers of teeth 65 may be used.

In embodiments, the teeth 65 protrude outward from a convex surface (of the eyelet 20') that defines the opening 50. In particular embodiments, the teeth 65 do not extend into a circular area defined by the opening 50. For example, as shown in FIG. 3, there is a gap 80 between the radial extent of each tooth and the circular area defined by the opening 50. In this manner, when viewed along the axis 75 (as shown in FIG. 3), the innermost portions of the teeth 65 define a circle that has a larger diameter than that of the opening 50. Due to this design, the cord 15 may be selectively positioned (i.e., as shown in FIGS. 6 and 7) to pass through the opening 50 while contacting the crown of the convex surface that defines the opening 50, but without contacting the teeth 65. In this manner, the cord 15 may be selectively positioned (i.e., as shown in FIGS. 6 and 7) to pass through the opening 50 while only being hindered by the friction between the cord 15 and the smooth crown of the convex surface that defines the opening 50, but without contacting the teeth 65. In this way, when the cord 15 is positioned with its long axis 77 (of the part of the cord 15 within and around the opening 50) parallel to the axis 75 of the circular opening, and without bending into contact with the teeth 65, the cord 15 may pass relatively easily through the eyelet 20' (i.e., in an unlocked position, as shown in FIGS. 6 and 7).

With reference now to FIGS. 8 and 9, after the distal end 35 of the cord 15 is passed through the opening 50 of the eyelet 20', the cord 15 may be bent to a locked position in which the cord 15 engages one or more of the teeth 65. This engagement between the cord 15 and the teeth 65 increases the friction between the cord 15 and the eyelet 20' (e.g., provides a greater amount of friction relative to the unlocked position shown in FIGS. 6 and 7), and prevents movement of the cord 15 through the opening 50. In this way, when the cord 15 is positioned with its long axis 77 (of the part of the cord 15 within and around the opening 50) non-parallel to the axis 75 of the opening 50, the cord 15 engages at least one of the teeth 65 and is prevented from passing through the eyelet 20' (i.e., in an locked position, as shown in FIGS. 8 and 9). In embodiments, the system is structured and arranged so that the cord 15 engages at least one of the teeth 65 when the axis 77 is angled at 15° or more relative to axis 75. In embodiments, the material of the eyelet 20' including the teeth 65, the geometry of the teeth 65, and the material and geometry of the cord 15 are designed together such that, when the belt 10 is in the locked position, the belt 10 withstands a pull force of 100 lbf (pound-force), meaning that the belt 10 will not permit the cord 15 to slide through the eyelet 20' when a tension force of up to 100 lbf is applied in the direction of arrows B shown in FIG. 11B.

As should be understood from the description thus far, a user may use the belt 10 in the following manner First, with the distal end 35 not yet passing through the eyelet 20', the user wraps the belt 10 around their waist, e.g., through belt loops in a garment such as pants, shorts, etc. The user then passes the distal end 35 through the opening 50 in the eyelet 20' while the cord 15 is in the unlocked position (e.g., as shown in FIGS. 6 and 7). The user continues moving the cord 15 through the eyelet 20' until the user finds the desired snugness of the belt 10. The user then bends the distal end 35 of the cord 15 relative to the eyelet 20' to put the cord 15 in the locked position (e.g., as shown in FIGS. 8 and 9). Additionally or alternatively to the user bending the distal end 35 by manually moving the distal end 35 relative to the eyelet 20', the user may also place the belt into the locked position by grasping intermediate portions of the cord 15 on opposite sides of the eyelet 20' and pulling these portions in opposite directions away from the eyelet 20'; the force provided by this pulling, combined with the arrangement of the proximal end looped around the eyelet 20' and being held rigid by the stem 55 of the eyelet 20' causes a portion of the cord 15 in and around the opening to bend into a position where the cord 15 engages one or more of the teeth 65. In this manner, the apparatus includes a self-locking functionality. The user may adjust the snugness of the belt 10 at any time by moving the cord 15 to the unlocked position, and then moving the distal end 35 forward or backward through the eyelet 20'. In this manner, the belt 10 is infinitely adjustable, and is not limited to a discrete number of sizes. After finding the desired snugness and arranging the cord 15 in the locked position, the user may stow the remainder of the distal end 35 by, for example, tucking it into an adjacent belt loop, tucking it into or around a portion of the cord 15, or may let the distal end 35 hang down freely. To remove the belt 10, the user moves the cord 15 to the unlocked position and then pulls the distal end 35 backward through the eyelet 20' such that the cord 15 is no longer passing through the eyelet 20'.

FIGS. 12-19 show an embodiment of the belt 10 in accordance with aspects of the invention. As shown in FIGS. 12-19, the belt 10 comprises the cord 15, sleeve 30, and eyelet 20" (which corresponds to the eyelet 20 shown in FIG. 1).

Figure 12:
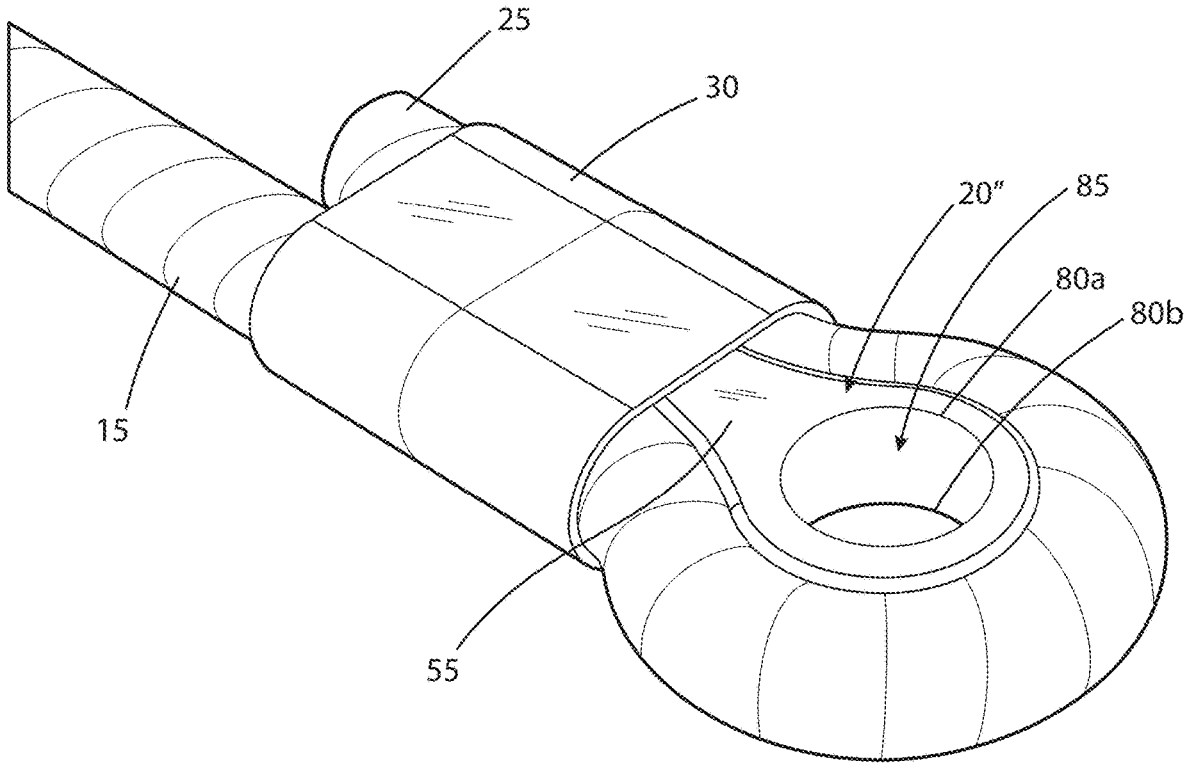
FIGS. 12-19 show another embodiment of the belt in accordance with aspects of the invention.
Figure 13:
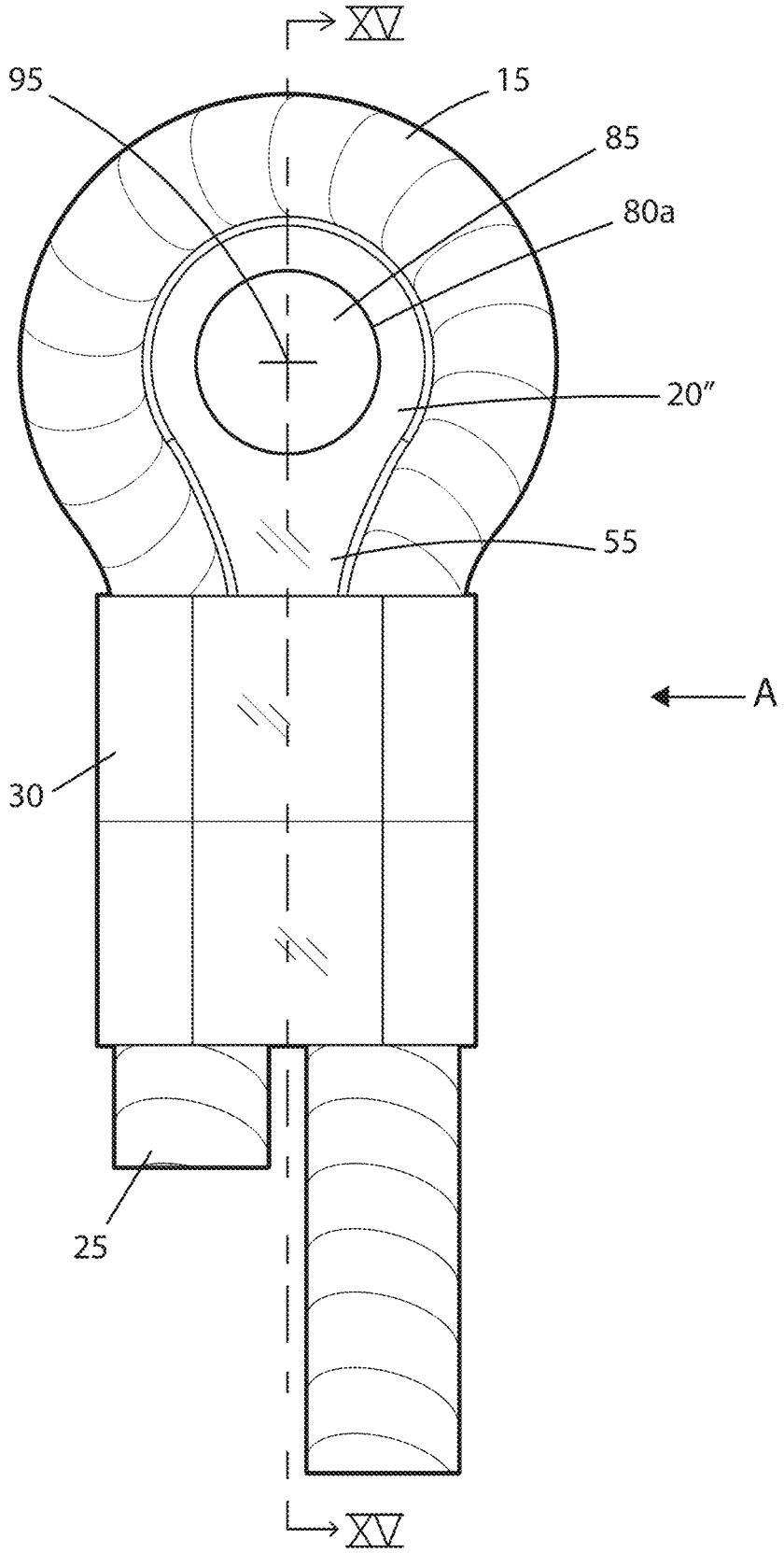

FIG. 12 shows a perspective view of a portion of the belt 10 including the proximal end 25 of the cord 15 wrapped around the eyelet 20". FIG. 13 shows a front view of the portion of the belt 10.

Figure 14:
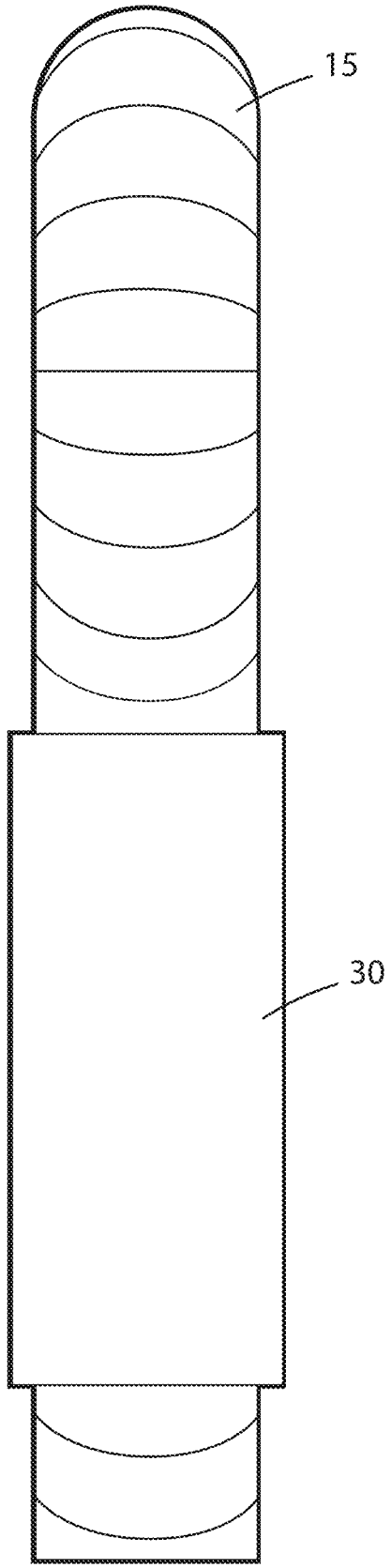
Figure 15:
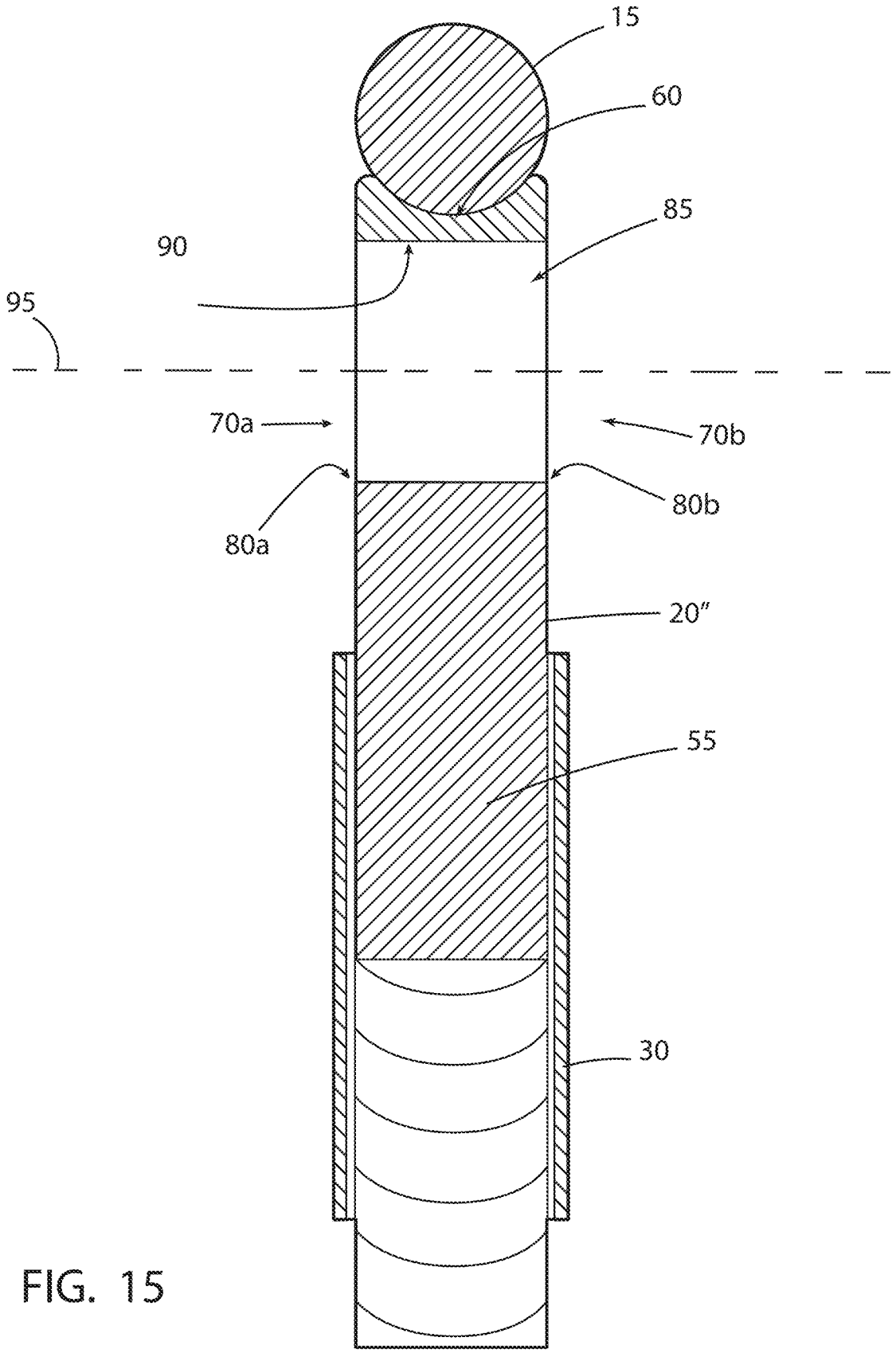

FIG. 14 shows a side view of the portion of the belt looking the direction of arrow A shown in FIG. 13, without the distal 35 end of the cord 15 passing though the eyelet 20". FIG. 15 shows a side cutaway view of the portion of the belt along line XV-XV of FIG. 13.

Figure 16:
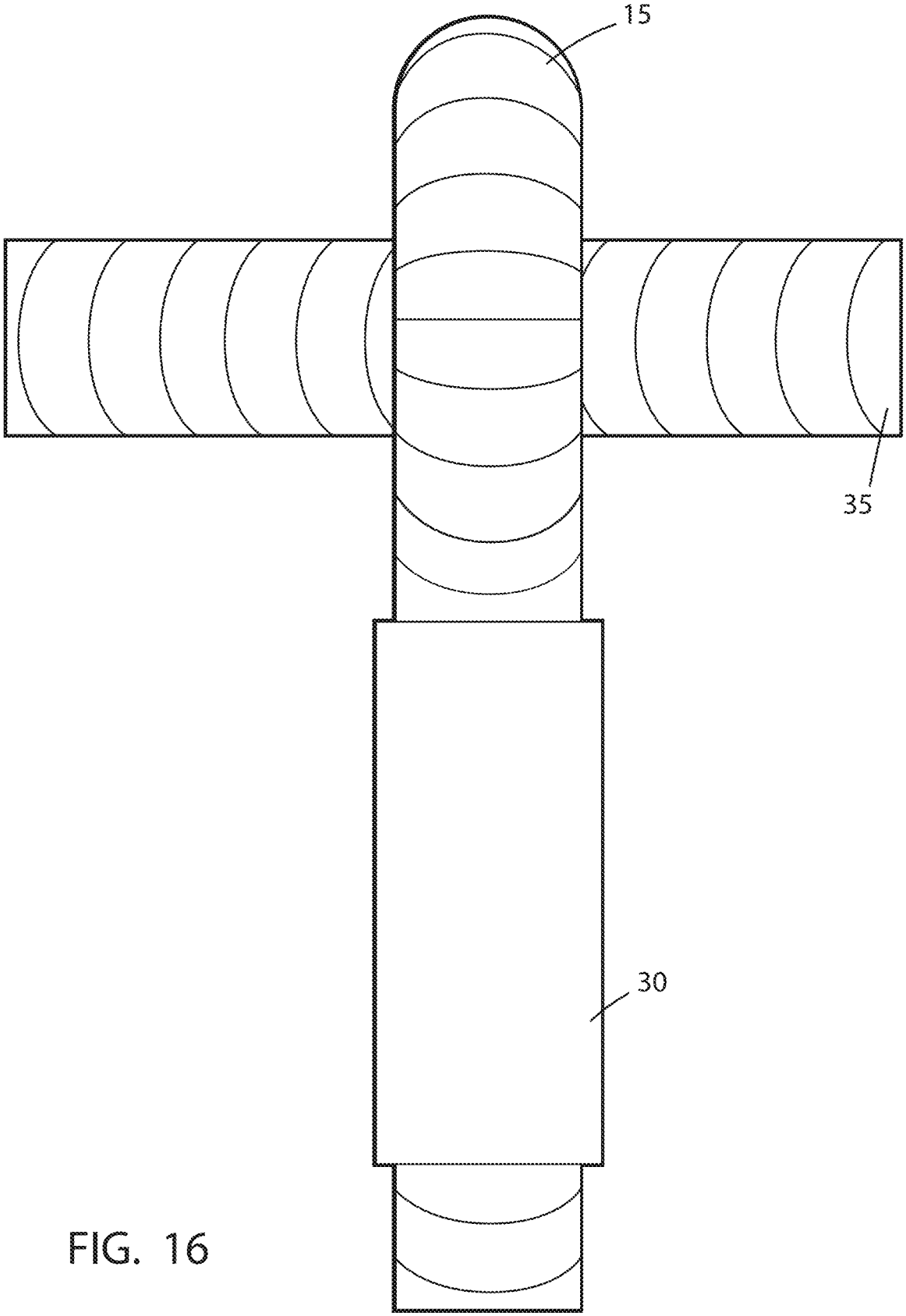

FIG. 16 shows a side view of the portion of the belt of FIG. 13, with the distal end 35 of the cord 15 passing though the eyelet 20" in an unlocked position. The view shown in FIG. 16 is along the same direction as the view of FIG. 14.

Figure 17:
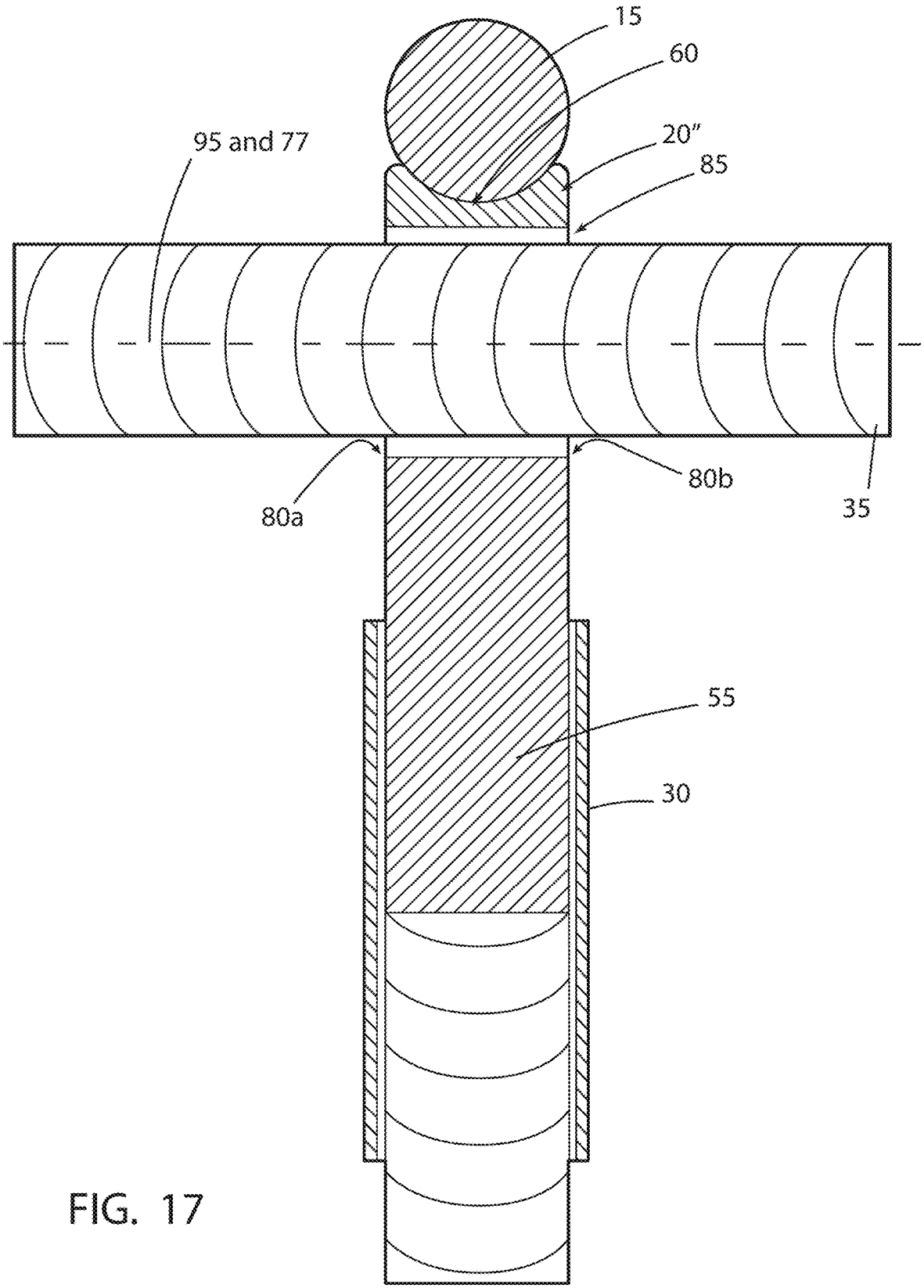

FIG. 17 shows a side cutaway view of the portion of the belt of FIG. 16 with the distal end 35 of the cord 15 passing though the eyelet 20" in the unlocked position. The view shown in FIG. 17 is along the same direction and cutaway plane as the view of FIG. 15.

Figure 18:
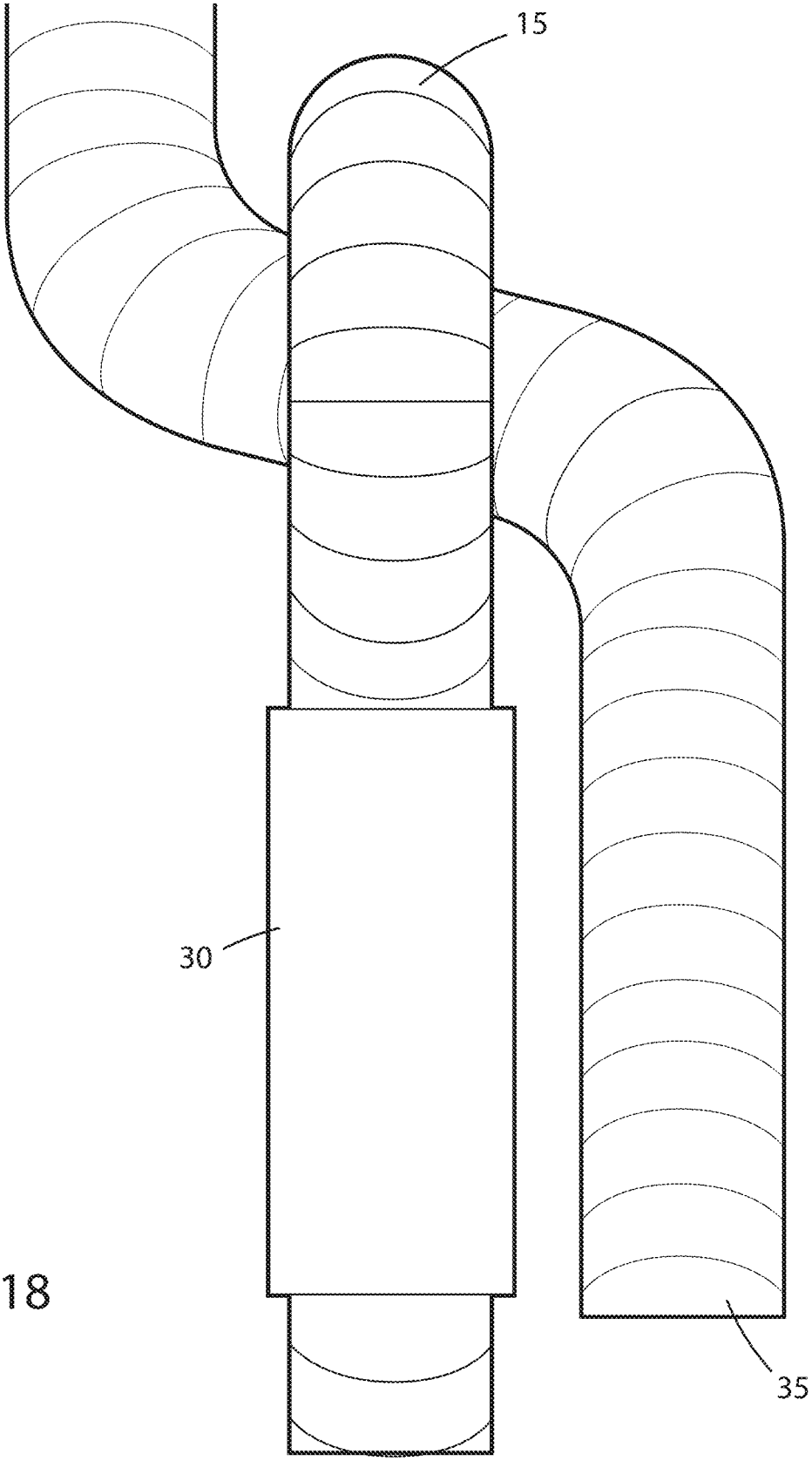

FIG. 18 shows a side view of the portion of the belt of FIG. 13, with the distal end 35 of the cord 15 passing though the eyelet 20" and bent in a locked position. The view shown in FIG. 18 is along the same direction as the view of FIG. 14.

Figure 19:
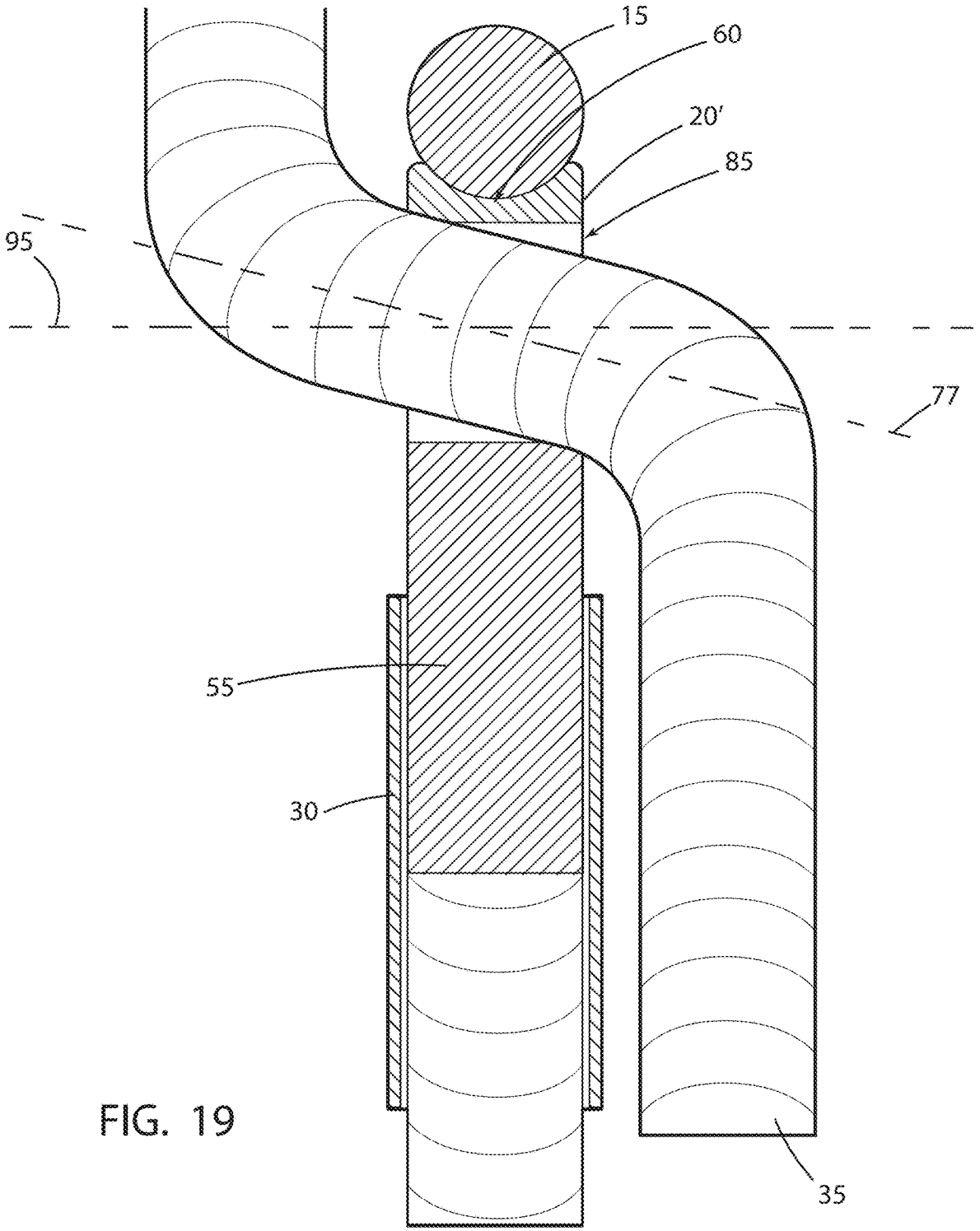

FIG. 19 shows a side cutaway view of the portion of the belt of FIG. 18 with the distal end 35 of the cord 15 passing though the eyelet 20" and bent in the locked position. The view shown in FIG. 19 is along the same direction and cutaway plane as the view of FIG. 15.

In the second embodiment shown in FIGS. 12-19, the cord 15 and sleeve 30 are the same as those previously described in the first embodiment. In the second embodiment shown in FIGS. 12-19, the eyelet 20" differs from the eyelet 20' in that the locking feature of the eyelet 20" comprises two edges 80*a* and 80*b* (shown in FIGS. 12 and 15) instead of plural teeth arranged concentrically around each side of the opening. In particular, as shown in FIGS. 12, 13, and 15, the eyelet 20" comprises a single through-bore 85 that defines the opening for the distal end 35 of the cord 15 to pass through. In embodiments, the bore 85 comprises a circular sidewall 90 that is symmetric about the axis 95 of the bore 85. The intersection of the sidewall 90 and the two opposed outer surfaces of the eyelet 20" form sharp edges 80*a* and 80*b*. The bore 85 is shown in the figures as a circular opening. However, the bore 85 may have other shapes provided that the shape achieves the selective locking and unlocking as described herein.

In this manner, when the cord 15 is positioned with its long axis 77 (of the part of the cord 15 within and around the bore 85) parallel to the axis 95 of the bore 85, and without bending into contact with the edges 80*a*, 80*b*, the cord 15 may pass relatively easily through the bore 85 (i.e., in an unlocked position, as shown in FIGS. 16 and 17).

With reference now to FIGS. 18 and 19, after the distal end 35 of the cord 15 is passed through the bore 85 of the eyelet 20", the cord 15 may be bent to a locked position in which the cord 15 engages one or more of the edges 80*a*, 80*b*. As with the previous embodiment, the locking may be accomplished by manually moving the distal end of the cord relative to the eyelet, or by grasping portions of the cord on either side of the eyelet and pulling the grasped portions of the cord away from the eyelet which causes the cord to bend relative to the eyelet and engage the locking feature in a self-arresting manner. This engagement between the cord 15 and the edges 80*a*, 80*b* increases the friction between the cord 15 and the eyelet 20" (e.g., provides a greater amount of friction relative to the unlocked position shown in FIGS. 16 and 17), and prevents movement of the cord 15 through the bore 85. In this way, when the cord 15 is positioned with its long axis 77 (of the part of the cord 15 within and around the bore 85) non-parallel to the axis 95 of the bore 85, the cord 15 engages at least one of the edges 80*a*, 80*b* and is prevented from passing through the eyelet 20" (i.e., in an locked position, as shown in FIGS. 18 and 19).

Figure 20:
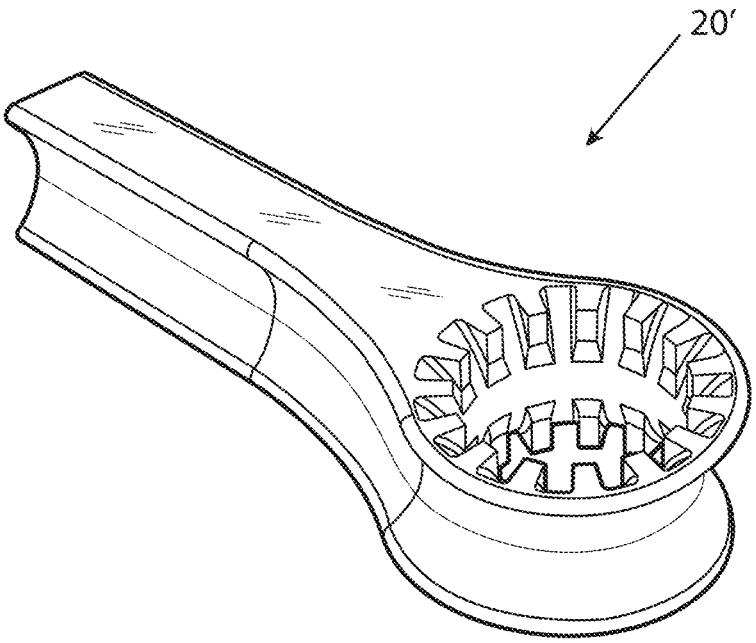
FIGS. 20-23 show an embodiment of an eyelet in accordance with aspects of the invention.
Figure 22:
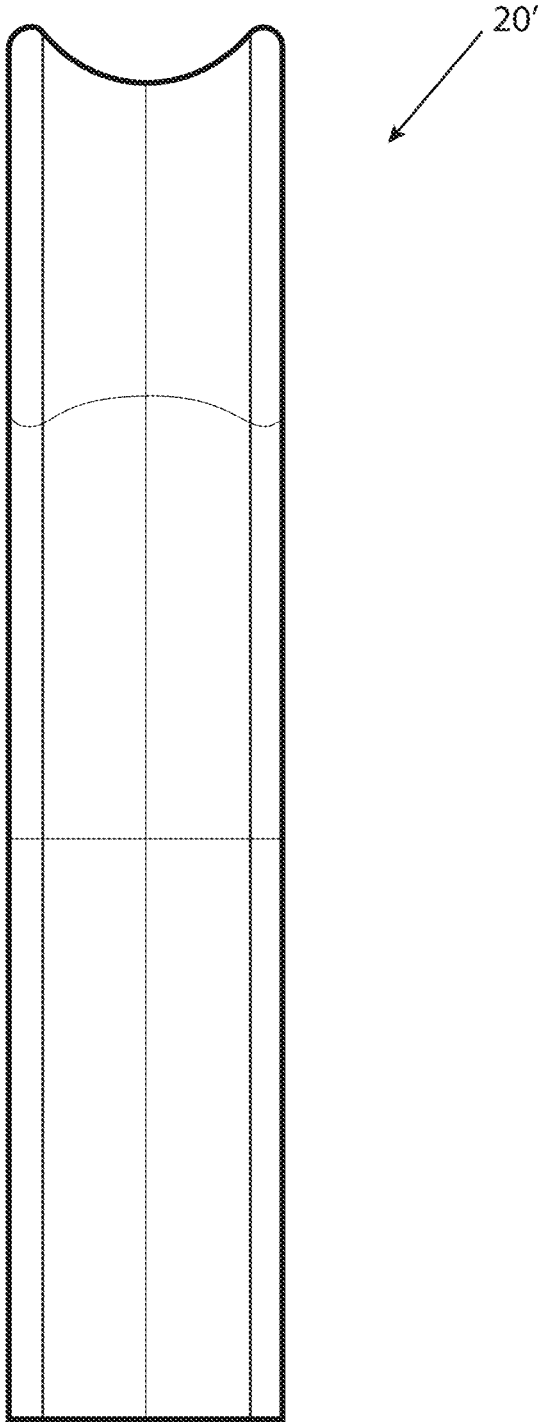
Figure 23:
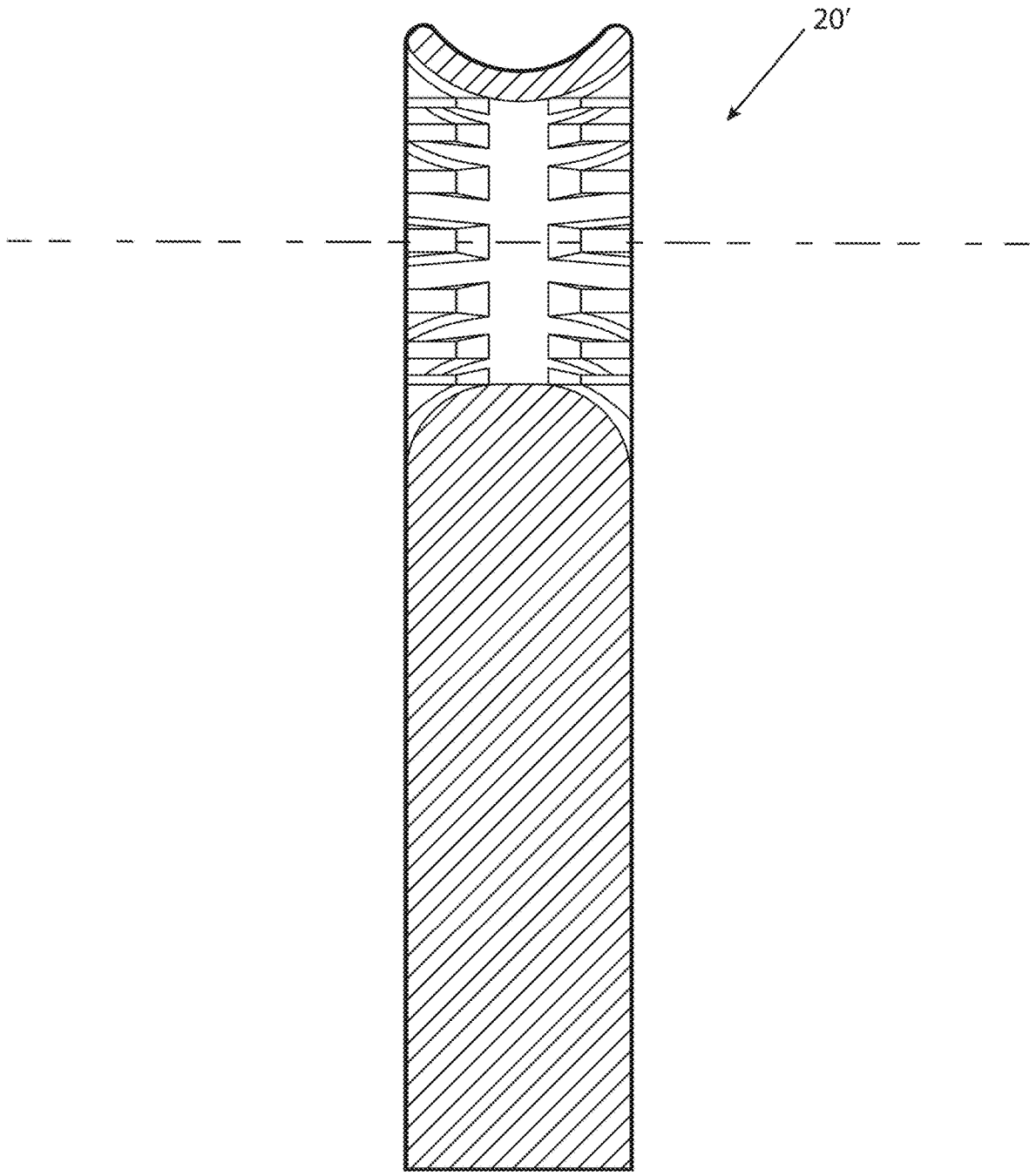
Figure 24:
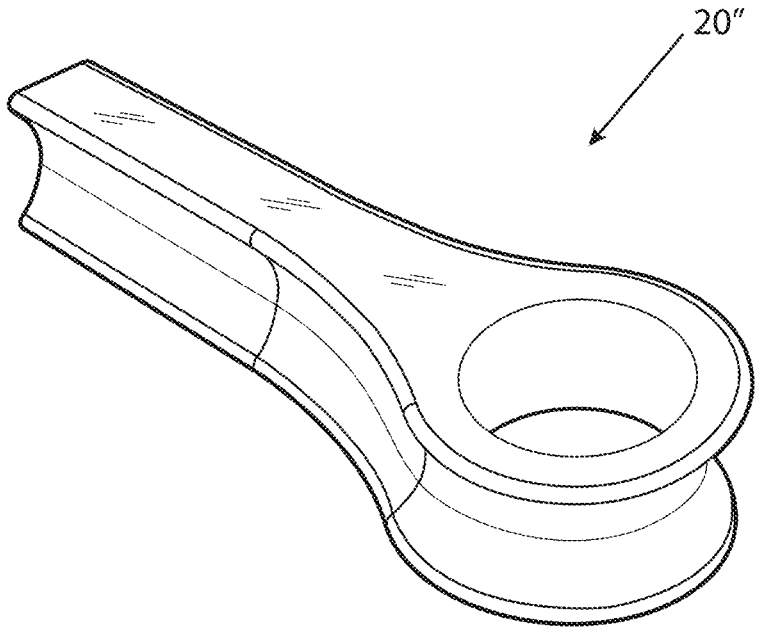
FIGS. 24-27 show another embodiment of an eyelet in accordance with aspects of the invention.
Figure 26:
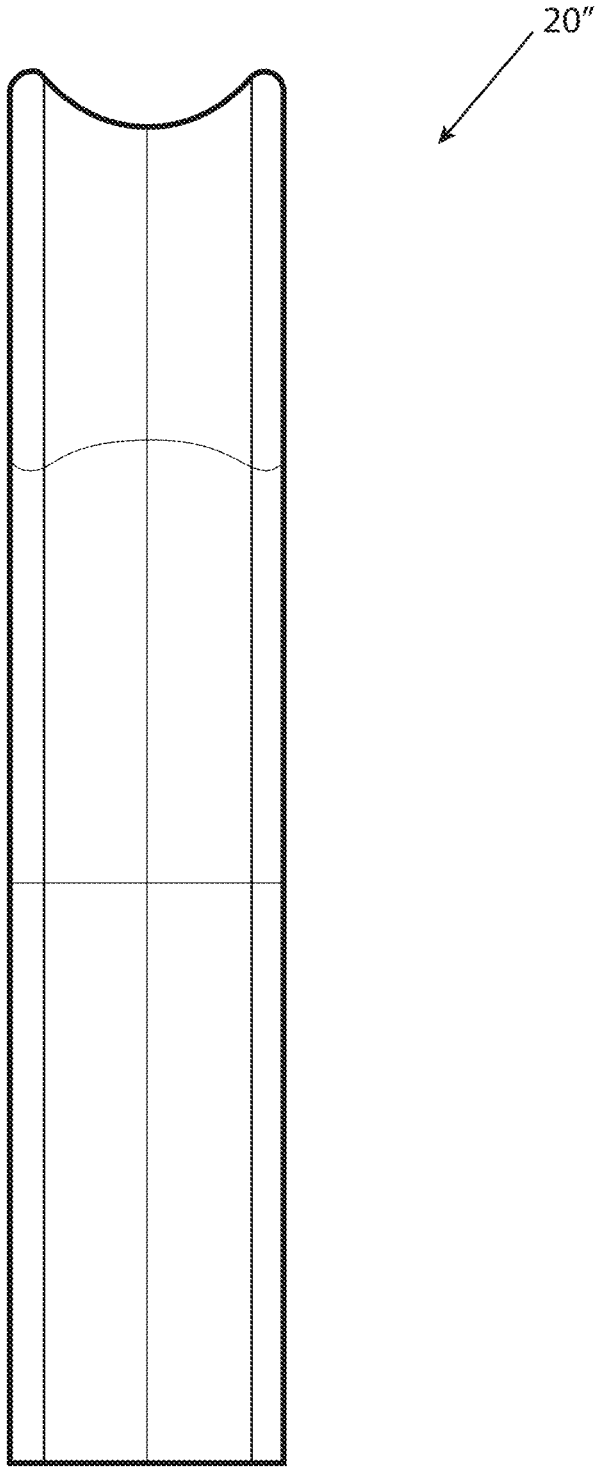
Figure 27:
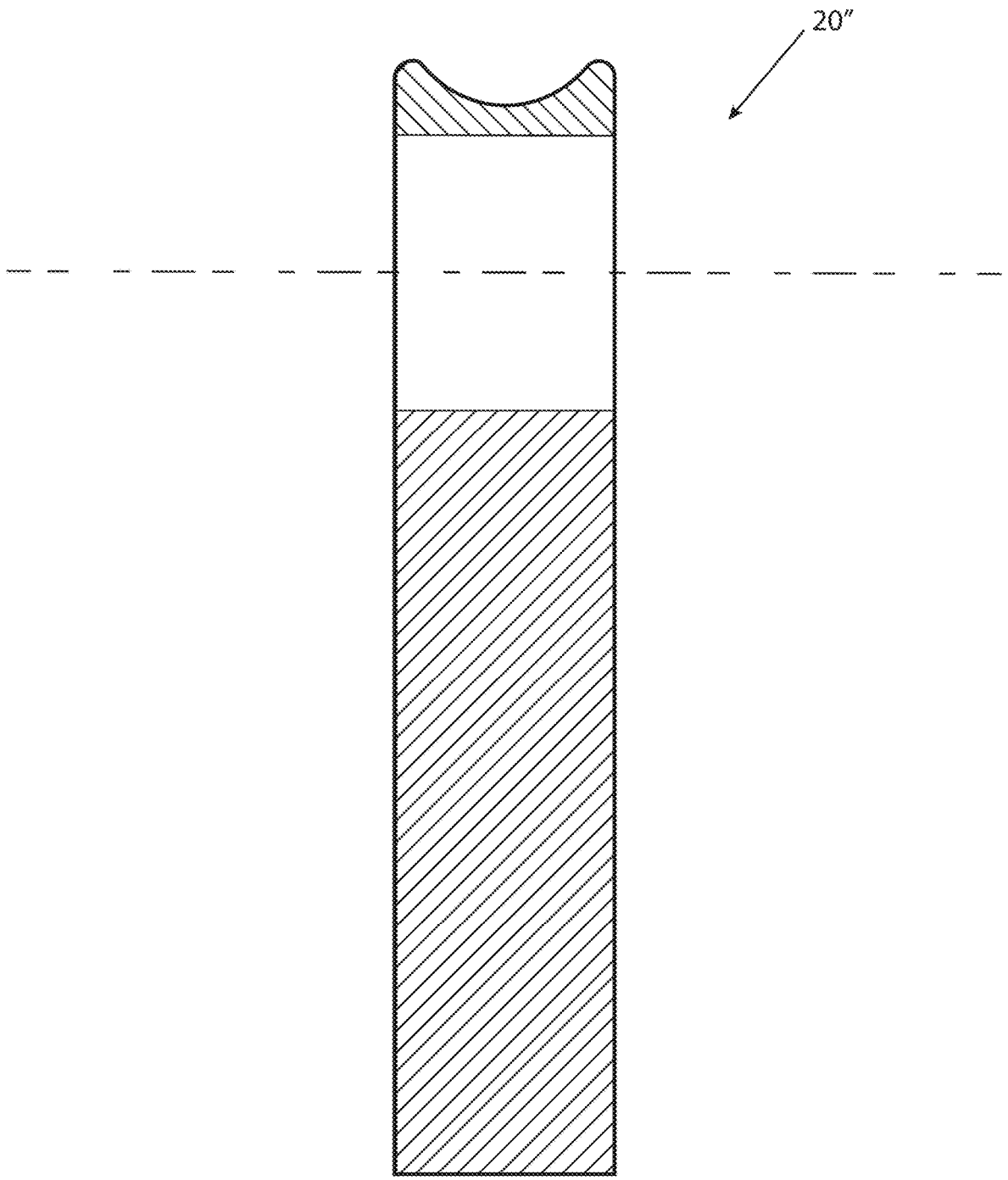

FIGS. 20-23 show the eyelet 20' in accordance with aspects of the invention. FIG. 20 shows a perspective view of the eyelet 20'. FIG. 21 shows as front view of the eyelet 20'. FIG. 22 shows a side view of the eyelet 20' viewed in the direction of arrow A shown in FIG. 21. FIG. 23 shows a side cutaway view of the eyelet 20' along plane XXIII-XXIII FIGS. 24-27 show the eyelet 20" in accordance with aspects of the invention. FIG. 24 shows a perspective view of the eyelet 20". FIG. 25 shows as front view of the eyelet 20". FIG. 26 shows a side view of the eyelet 20" viewed in the direction of arrow A shown in FIG. 25. FIG. 27 shows a side cutaway view of the eyelet 20" along plane XXVII-XXVII.

It is noted that the foregoing examples have been provided merely for the purpose of explanation and are in no way to be construed as limiting aspects of the present invention. While aspects of the present invention have been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although aspects of the present invention have been described herein with reference to particular means, materials and embodiments, aspects of the present invention are not intended to be limited to the particulars disclosed herein; rather, aspects of the present invention extend to all functionally equivalent structures, methods and uses, such as are within the scope of the appended claims.

What is claimed:

1. An apparatus, comprising:

a cord comprising a proximal end and a distal end; and an eyelet comprising an opening and a locking feature, wherein the proximal end of the cord is looped around the eyelet;

the distal end of the cord is configured to pass through the opening, wherein the cord and the eyelet combine to form a continuous closed loop when the distal end of the cord is passed through the opening;

the locking feature is structured and arranged to selectively lock and unlock movement of the cord through the opening; and the eyelet is configured to allow the distal end of the cord to pass through the opening no more than a single time.

2. The apparatus of claim 1, wherein the cord and the eyelet are structured and arranged with relative sizes such that:

the cord is disengaged from the locking feature and in an unlocked position relative to the eyelet when the cord is positioned within the opening with its long axis parallel to an axis of the opening; and the cord is engaged with the locking feature and in a locked position relative to the eyelet when the cord is positioned within the opening with its long axis non-parallel to the axis of the opening.

3. The apparatus of claim 1, wherein the eyelet is a unitary structure and has no moving parts.

4. The apparatus of claim 1, wherein the opening is circular and the only opening through the eyelet.

5. The apparatus of claim 1, wherein the cord and the eyelet are structured and arranged with relative sizes such that only a single portion of the cord fits inside the circular opening at one time.

6. The apparatus of claim 1, wherein an outside diameter of the cord is substantially equal to a diameter of the circular opening.

7. The apparatus of claim 1, wherein the distal end of the cord is devoid of any loops, knots, rigging hardware, and connecting hardware.

8. The apparatus of claim 1, wherein:

the proximal end of the cord is connected to an intermediate portion of the cord; and the eyelet comprises a stem extending between the proximal end of the cord and the intermediate portion of the cord.

9. The apparatus of claim 1, wherein the locking feature comprises plural teeth around the opening.

10. The apparatus of claim 9, wherein the plural teeth comprise:

a first set of teeth circumferentially around a first side of the opening; and a second set of teeth circumferentially around a second side of the opening.

11. The apparatus of claim 1, wherein:

the opening is defined by a through-bore with a sidewall that is symmetric about an axis of the bore; and the locking feature comprises edges defined by an intersection of the sidewall and two opposed outer surfaces of the eyelet.

12. The apparatus of claim 1, wherein the apparatus comprises a belt.

13. The apparatus of claim 12, wherein the cord comprises a rope having a core and a braided sheath around the core.

14. The apparatus of claim 1, wherein:

the eyelet is a unitary structure and has no moving parts;

the eyelet comprises a concave seat and the proximal end of the cord is looped around the eyelet in the concave seat;

the opening is the only opening through the eyelet;

the cord and the eyelet are structured and arranged with relative sizes such that only a single portion of the cord fits inside the opening at one time;

the distal end of the cord is devoid of any loops, knots, rigging hardware, and connecting hardware;

the proximal end of the cord is connected to an intermediate portion of the cord; and the eyelet comprises a stem extending between the proximal end of the cord and the intermediate portion of the cord.

15. The apparatus of claim 1, wherein the eyelet is a unitary structure comprising a stem extending between and contacting the proximal end of the cord and an intermediate portion of the cord.

16. An apparatus, comprising:

a cord comprising a proximal end and a distal end; and an eyelet comprising an opening and a locking feature, wherein the proximal end of the cord is looped around the eyelet;

the distal end of the cord is configured to pass through the opening, wherein the cord and the eyelet combine to form a continuous closed loop when the distal end of the cord is passed through the opening;

the locking feature is structured and arranged to selectively lock and unlock movement of the cord through the opening;

the locking feature comprises plural teeth around the opening; and the plural teeth protrude outward from a convex surface that defines a circular opening.

17. The apparatus of claim 16, wherein the plural teeth do not extend into a circular area defined by a crown of the convex surface.

18. An apparatus, comprising:

a cord comprising a proximal end and a distal end; and an eyelet comprising an opening and a locking feature, wherein the proximal end of the cord is looped around the eyelet;

the distal end of the cord is configured to pass through the opening, wherein the cord and the eyelet combine to form a continuous closed loop when the distal end of the cord is passed through the opening; and the locking feature engages the cord and locks the cord relative to the eyelet when the cord is positioned within the opening with its long axis non-parallel to an axis of the opening.

19. The apparatus of claim 18, wherein the eyelet is a unitary structure and has no moving parts.

20. The apparatus of claim 18, wherein the eyelet is a unitary structure comprising a stem extending between and contacting the proximal end of the cord and an intermediate portion of the cord.

* * * * *